US005577838A

United States Patent [19]

Lucas

[11] Patent Number: 5,577,838

[45] Date of Patent: Nov. 26, 1996

[54] PRECISION CHANDELIER FRAME AND METHOD FOR CONSTRUCTING THE SAME

[75] Inventor: John M. Lucas, Cadyville, N.Y.

[73] Assignee: Schonbek Worldwide Lighting, Inc., W. Plattsburgh, N.Y.

[21] Appl. No.: 88,670

[22] Filed: Jul. 7, 1993

[51] Int. Cl.[6] ..... F21S 1/06

[52] U.S. Cl. ..... 362/405; 248/343

[58] Field of Search ..... 362/404, 405, 362/406, 450, 806, 147, 352; 248/221.3, 342, 343, 344

[56] References Cited

U.S. PATENT DOCUMENTS

| | | | |
|---|---|---|---|
| 434,161 | 8/1890 | Russell | 362/450 |
| 1,032,660 | 7/1912 | Czerny | 362/405 X |
| 1,530,993 | 3/1925 | Framburg | 362/406 |
| 1,534,662 | 4/1925 | Riddle | 362/406 |
| 1,610,483 | 12/1926 | Blackwell | 362/307 |
| 1,629,489 | 5/1927 | Dvorak | 362/405 |
| 1,644,452 | 10/1927 | Spencer | 362/408 |
| 1,668,772 | 5/1928 | Kestell | 362/405 |
| 1,887,397 | 11/1932 | Capocci | 362/121 |
| 2,437,350 | 3/1948 | Ferlin et al. | 362/241 |
| 3,180,982 | 4/1965 | Derman et al. | 362/450 |
| 3,530,289 | 9/1970 | Friedman et al. | 362/405 |
| 4,477,866 | 10/1984 | Goralnik | 362/427 |
| 5,222,805 | 6/1993 | Schonbek et al. | 362/405 |

FOREIGN PATENT DOCUMENTS

| | | |
|---|---|---|
| 572602 | 11/1958 | Belgium . |
| 0179638 | 4/1986 | European Pat. Off. . |
| 1212045 | 3/1960 | France . |
| 1487840 | 5/1967 | France . |
| 2445486 | 7/1980 | France . |
| 2612604 | 9/1988 | France . |
| 2057112 | 3/1981 | United Kingdom . |

*Primary Examiner*—Stephen F. Husar

[57] ABSTRACT

A chandelier frame provides, in one embodiment, a first frame member and a second frame member that are connected by a plurality of arms at joints. The joints are plastically and asymmetrically deformed to locate each of the frame members in axially remote planes. In another embodiment, this invention provides a first and second frame member having arms therebetween that are rotated from a first plane defined by the frame members into a second plane that is substantially transverse to the first plane. The arms are joined to a locking structure that enables the first and second frame members to be maintained in an elastically deformed shape defining, in one preferred embodiment, a bowl-like shape. In another embodiment, a frame member is held in an elastically deformed, stressed state by an arm interconnected with interengaging locking structures on the arm. The spacing between arm locking structures is different from the spacing of interengaging a frame member locking structures to enable formation of the plastically deformed shape.

79 Claims, 29 Drawing Sheets

PRECISION CHANDELIER FRAME AND METHOD FOR CONSTRUCTING THE SAME

FIELD OF THE INVENTION

This invention relates to high tolerance chandelier frames and a method of constructing such frames from flat material with a minimum of equipment.

BACKGROUND OF THE INVENTION

In the construction of chandelier frames, it is often desirable to provide complicated frameworks emanating from a center post. These frameworks are used to hold a variety of ornaments, typically of cut crystal. Such frameworks can have the shape of a bowl, a pair of spaced rings, a number of flower-like petals or any other of a variety of complex shapes that extend in three dimensions.

In the past, chandelier frames have been constructed typically by bending a large number of precut lengths of steel strip or wire and joining the bent pieces into a frame structure by welding or soldering. FIG. 1 illustrates a bowl-shaped chandelier frame 40 formed from a large number of bent strips 42, rectangular in cross-section. The strips 42 are joined by hand soldering or welding (joints 44 of FIG. 2) at their points of interconnection. In order to acheive a bowl or hemispherical-shape, the strips 42 must be individually bent in two dimensions—a costly and exacting process. Ornament hanging tabs 46 must often be attached individually in a painstaking operation by welding the tabs one at a time to the frame.

The prior art frame 40 of FIG. 1 is manufactured on a complicated welding jig that is constructed specifically for a given type of chandelier frame design. The construction of such a chandelier frame entails many hours of painstaking labor by a highly skilled craftsman. Despite the craftsman's skill, however, imperfect frames that are commercially unacceptable often result from the process. Even when frames are not so flawed as to be commercially unmarketable, the hand construction process often yields chandelier frames with minor imperfections and misalignments that detract from the desired optical effect when ornaments are attached.

U.S. Pat. No. 5,222,805 discloses a major improvement to the process of manufacturing chandelier frames. This application shows that frames can be constructed of members that are precisely cut from sheet stock by a computer-controlled laser cutter. The cut members can be assembled rapidly by joining the members together at various preformed attachment locations using slots and twistable tabs. This technique can eliminate many steps in the manufacturing process, including virtually all welding steps. The chandelier frames are produced more quickly, and the overall alignment of the frames achieves a precision that was never achieved in the prior art.

The present invention represents a substantial improvement in the manufacture of chandelier frames. One object of this invention is to provide a method for the rapid construction of chandelier frames having curved-surface shapes. Another object of this invention is to provide a chandelier frame having enhanced rigidity. The chandelier frame should be easy to assemble using relatively unskilled labor, and the frame members should be formable using flat, sheet stock that can be cut by, for example, a laser cutting device. The method should allow construction of complex frames that extend in each of three dimensions.

SUMMARY OF THE INVENTION

This invention relates to a chandelier frame that is typically constructed from flat, non-stressed pieces, using elastic and plastic deformation to locate the flat pieces into a non-flat, deformed, orientation. In one embodiment, the chandelier frame includes a first and a second frame member that are remote from each other and that are connected by a plurality of arms. The first frame member is connected to each arm at a first joint that is plastically and asymmetrically deformed and that is free of breaks. The second frame member can also be connected to each arm at a respective second joint that is, also, plastically and asymmetrically deformed and free of breaks. Alternatively, the second frame member can be locked together so that the first frame member is located in a non-planar, elastically stressed position. The locking can be accomplished by a tab and slot arrangement.

In another embodiment, a chandelier frame can be constructed by cutting a first frame member, a second frame member and a plurality of arms, wherein the arms include first and second joints that are aligned non-radially, relative to a radius passing through a center of the frame members. The first frame member can comprise a flat sheet lying in a first plane. A separation force is applied between the first and second frame members in a direction substantially perpendicular to the first plane and a simultaneous rotation can be imparted between the first and second frame members to place the arms into a predetermined alignment and to locate the second frame member in a second plane remote from the first plane. This predetermined alignment can, preferably, be one in which the arms are located in planes substantially perpendicular to planes defined by the first and second frame members.

According to another embodiment, a chandelier frame can be constructed by cutting the first frame member, second frame member and plurality of arms from a sheet that lie substantially in a first plane in such a manner that the arms connect the first and second frame members together. The arms can then be rotated by twisting to locate the arms in respective planes aligned substantially transverse to the first plane. The first frame member can be elastically deformed into a bowl-shape and the shape can be maintained by attaching a third frame member to the twisted arms.

According to another embodiment, a chandelier frame comprises a first frame member and an arm member connected to the first frame member. The arm member carries a locking structure, and the arm member is twisted into a plane substantially transverse to a plane defined by the first frame member, when the frame member is in an unstressed state. By twisting the arm member, the locking structure is positioned at a point remote from the plane defined by the first frame member. A second frame member can be provided that is locked to the locking structure.

According to a further embodiment, a chandelier frame comprises a first ring that is substantially flat and defines a plane in an unstressed state. A locking frame member is provided that includes a locking structure for interengaging the first ring. The locking structure is locked to the first ring in a predetermined relationship to hold the ring in a non-flat, stressed, elastically deformed state. The locking frame member can be free of breaks and integrally formed with the first ring. The locking structure of the locking frame member can interengage a locking structure of arms that are connected to the first ring to hold the first ring in an elastically deformed state.

According to this invention, a workpiece for a chandelier frame comprises a first ring, a second ring concentric with and lying in the plane of the first ring, and a plurality of arms that connect the rings at joints. The first and second ring are flat and lie substantially within a plane. The arms are joined to the rings at joints that are non-radially aligned relative to a radius passing through a center of the rings. By applying a separation force and causing a rotation between the rings, the rings can be positioned in axially remote planes and the arms can be brought into an orientation that is substantially perpendicular to planes defined by the rings.

Another workpiece for a chandelier frame according to this invention comprises a first ring, a second ring concentric with and lying within the first ring, and a plurality of arms connecting the first ring and the second ring and joints. The first ring and the second ring are substantially flat and coplanar. The joints are constructed so that they permit plastic and asymmetric deformation without substantial deformation of the first ring, the second ring or the arms. The joints can be narrow to enable a sharp or rapid bend to be formed therein. The arms can include locking structures that, in a preferred embodiment, can comprise deformable tabs.

Another workpiece for a chandelier frame according to this invention can comprise a plurality of frame loops interconnected to form a ring and a plurality of arms that are within respective frame loops and that interconnect opposite ends of the loop. According to a preferred embodiment, the arms can, themselves, comprise loops and can include a locking structure. The arm can also include joints that permit the arms to be twisted into a plane substantially transverse to a plane defined by the frame loops.

A method for constructing a chandelier frame according to this invention includes providing a frame member that lies substantially in a plane in an unstressed state. Stress is applied to cause elastic deformation in the frame member so that it forms a predetermined bowl-shape. The frame member is then secured in an elastically stress state to maintain the predetermined bowl-shape. Predetermined sections of the frame member can be plastically deformed, according to this method, so that predetermined portions of the plastically deformed sections oriented transversely to the plane of the frame member. A locking structure can be secured to the portions to maintain the frame member in the predetermined bowl-shape.

Another method for constructing a chandelier frame according to this invention includes step of providing first and second frame members having first and second pairs of locking structures. The first and second pairs of locking structures are spaced differently, but are constructed to interengage with each other. The first frame member is elastically deformed to bring the first pair of locking structures into alignment with the second pair of locking structures and the locking structures are attached together to, thereby, maintain the first frame member in the elastically deformed state.

According to yet another method, a two-tier chandelier frame is constructed by providing a substantially flat frame member having a base, first arm extending from the base, first support structure extending from the first arm and a second support structure interconnected by a runner to the second arm. The second support structure includes a second arm that extends therefrom and that has a free end. The runner is plastically and asymmetrically deformed so that the second support structure is aligned in a plane axially remote from a plane defined by the first support structure. The second arm is also plastically deformed so that the free end of the arm is located adjacent the base. The second arm is then attached to the base. The base and free end of the second arm can include interengaging locking structures such as tabs and slots. According to this invention, a plurality of frame members as defined above can be assembled to form a ring having two-tiers. The first and second support structures can be used to hold glass rods and ornament chains according to a preferred embodiment. In such an embodiment, the base can comprise an inner ring.

BRIEF DESCRIPTION OF THE DRAWINGS

The foregoing and other objects and advantages of the invention will become more clear with reference to the following detailed description as illustrated by the drawings, in which.

DETAILED DESCRIPTION OF THE PREFERRED EMBODIMENT

Figure 1:
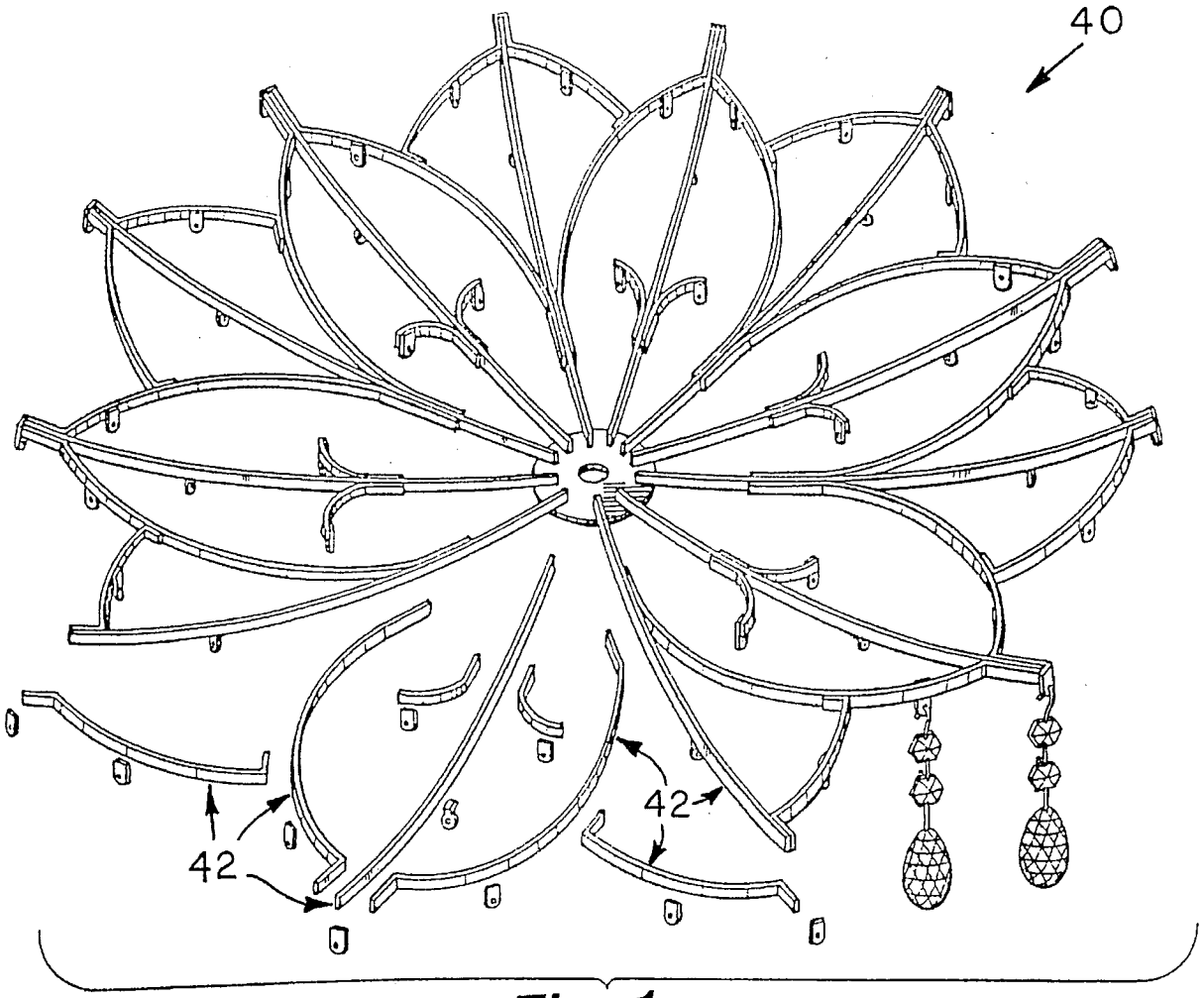
Fig. 1 (PRIOR ART)
FIG. 1 is a partially-exploded perspective view of a chandelier frame according to the prior art.
Figure 2:
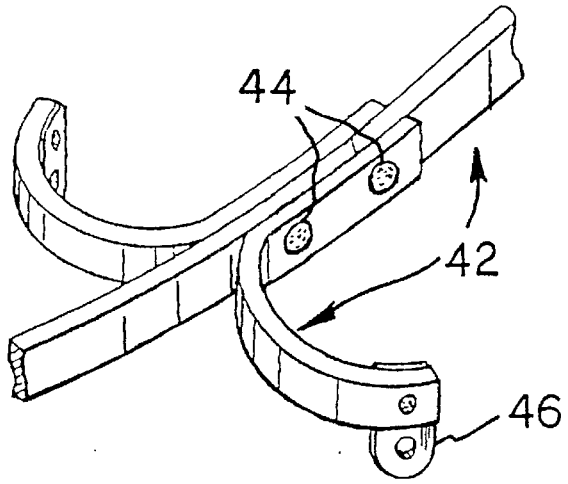
Fig. 2 (PRIOR ART)
FIG. 2 is a detailed perspective view of a portion of the frame of FIG. 1.
Figure 3:
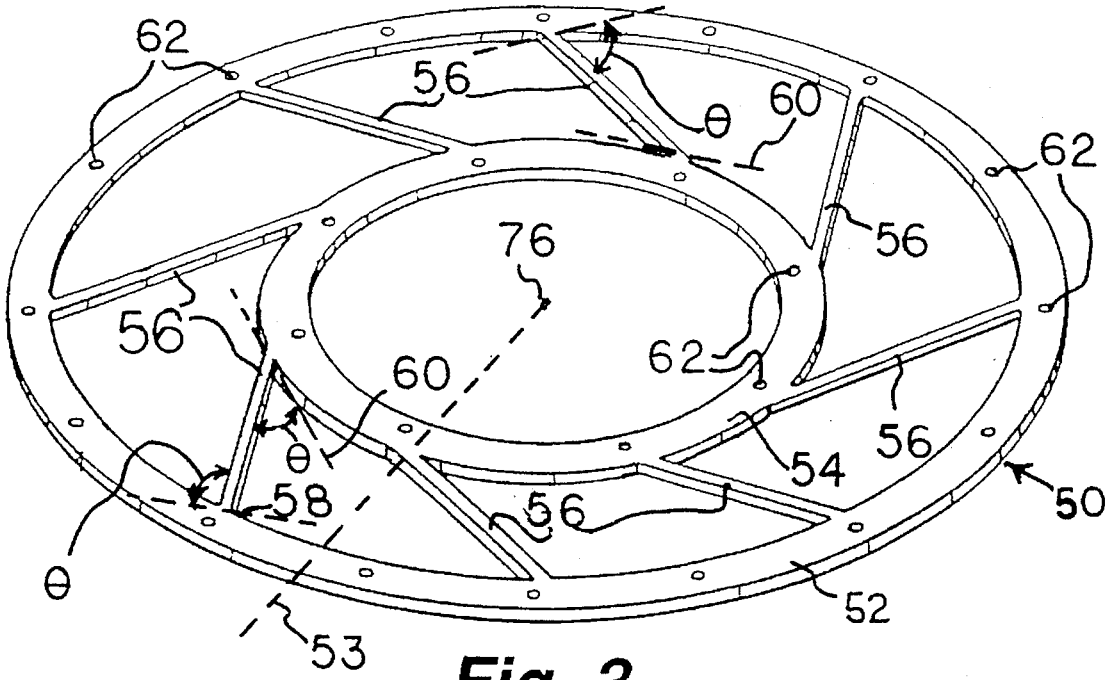
FIG. 3 is a perspective view of a frame member according to one embodiment of this invention.
Figure 4:
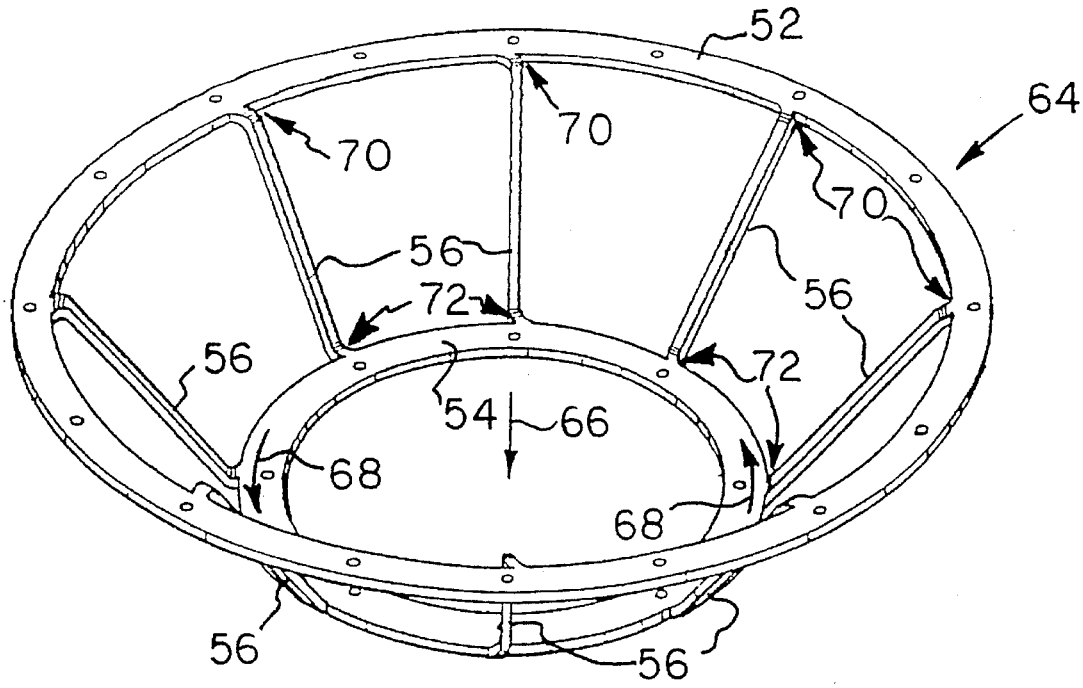
FIG. 4 is a perspective view of a chandelier frame formed from the frame member of FIG. 3.
Figure 5:
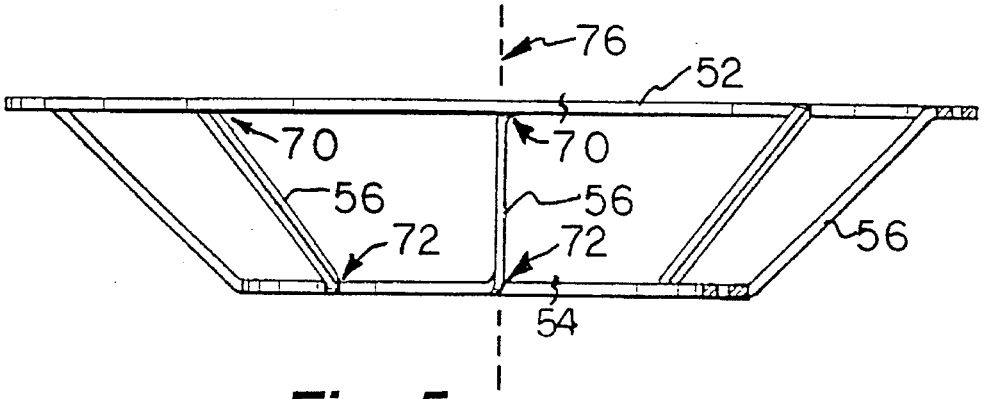
FIG. 5 is a side view of the formed chandelier frame of FIG. 4.

This invention relates to the formation of chandelier frame structures from substantially flat sheet stock, that is deformable either elastically or plastically to generate three-dimensional structures from an otherwise flat or "planar" member. FIGS. 3–5 illustrate a basic embodiment for constructing a chandelier frame according to this invention involving permanent or "plastic" deformation of a substantially planar frame member into a three-dimensional shape. Throughout this description, the term "three-dimensional" is used with reference to chandelier frame members formed from flat "two-dimensional" sheet stock having a thickness that is substantially smaller than the length and width of the sheet. While such sheet stock is, technically, three-dimensional, in that it has a finite thickness, it should be understood that, for the purposes of this discussion, three-dimensional shall refer to a frame member that is deformed so that it projects in three-dimensions without regard to its actual thickness. In other words, if the sheet's thickness were infinitely small, the frame member would still project in three-dimensions upon deformation.

As shown in FIG. 3, a frame member is cut into the illustrated shape from a piece of flat sheet stock. According to this invention, C 1008/10 cold rolled full hardened temper steel sheet having a minimum hardness of B84 and preferred hardness of B90 is utilized. The sheet is generally 0.074 inch in thickness, but can vary in thickness depending upon the application. Typically higher weight-handling capabilities require a thicker sheet.

The frame member 50, and all other frame members discussed herein, can be constructed from sheet material using a die stamp or, preferably, a laser cutting machine operated by a computer that is programmed with frame member shape data. A technique for forming flat chandelier frame members with a laser cutting device is discussed in U.S. Pat. No. 5,222,805. The teachings thereof are expressly incorporated herein by reference. As noted above, the words "planar" or "flat" shall refer to sheet stock pieces that have width and length dimensions that are substantially greater than their thickness dimension, such that the piece essentially lies in, and appears to define, a plane taken along its length and width. In this embodiment, each of the rings 52 and 54 includes holes 62 that can be used for mounting ornaments.

The planar member 50 of FIG. 3 comprises an outer ring 52 and an inner ring 54 that are separated by a plurality of spokes or arms 56. The arms 56 define acute angles θ relative to respective tangent lines 58 and 60 taken along a point of intersection of the arm with each of the inner and outer rings 52 and 54. The complement to angle θ is obtuse. Hence, the arms 56 define an acute and obtuse angle at their points of connection with the rings, rather than a right angle. In other words, the spokes 56 are at an angle relative to a radius 53 taken from a center axis 76 of the rings 52 and 54. As used herein, such orientation of arms between rings shall be termed "non-radially aligned." The flat frame member 50 is deformed into three-dimensional frame 64 as shown in FIG. 4. Specifically, by applying pressure to either inner ring 54 or outer ring 52 while holding the other ring stationary (arrow 66) and applying a slight rotational force to one of the rings (arrows 68) the opposing ends of the arms are made to permanently deform, generating the bends 70 and 72 that cause rings 52 and 54 to become axially spaced relative to one another. By "axially spaced", it is meant that the rings are oriented about a common axis 76 (FIG. 5), but define planes passing through remote points on that axis. The opposing ends of the arms, likewise, are brought into roughly perpendicular orientation relative to the planes of the rings. By forming the arms non-radially, the arms are longer than they would be if they lied on radius lines. Thus, the extra length allows the arms to define an axial spacing between rings when the arms are made perpendicular to the rings.

As shown in more detail in FIG. 5, the bends 70 and 72 are relatively localized to the ends of the rings 52 and 54, respectively (i.e. they are "rapid" bends). Accordingly, the arms 56 remain substantially straight along their lengths. Note that the application of both rotation (arrow 68) and axial stress (arrow 66) causes an "asymmetrical" bend at locations 70 and 72. The arms are bent in at least two rotational directions that lie in transverse planes, and the resulting bends 70 and 72 are compressed and expanded unevenly with respect to the planes of the rings 52 and 54. Accordingly, as used herein, such bends shall be termed "plastic and asymmetrical deformation."

By setting the width of the arms 56 to a proper dimension for a given material, the bends 70 and 72 remain rapid and largely localized at the opposing ends of the arms. However, if the width is too great, the bend occurs over a larger length of the arm. In this example, for fully hardened steel, having a thickness of between approximately 0.062 and 0.074 inch, the width of the arms 56, at least adjacent their opposing ends, should be sized to approximate the sheet stock thickness. In other words, the arms should have an approximately square cross-section adjacent their ends where they join the rings. As described further below, the width of the arms, remote from the arm ends, can be greater than at the ends. However, in general, at least two times the sheet stock thickness from the end of the arm (where it interconnects with a ring) should have an approximately square cross-section to facilitate the desired rapid bend section at the arm end. A preferred end section length for 0.074 inch sheet stock is approximately 0.2 inch according to this invention.

Unlike conventional chandelier frames, in which axially spaced rings are formed by attaching the rings to a central post or attaching arms between the rings, the frame members according to this embodiment are "integral" and "free of breaks" therealong. By "integral", it is meant that the arms are formed as a continuous part of the rings or frame members. In other words, an "integral" arm would be one that is formed of the same material as, that is cut as a part of, and that connects and holds together the inner and outer rings when the flat member is initially formed from sheet stock. The arm is, thus, left attached to each of the inner and outer rings subsequent to the initial flat member forming process. To this end, the arm is "free of breaks" therealong between each of the rings, and includes no mechanical, weld or solder joints.

Figure 6:
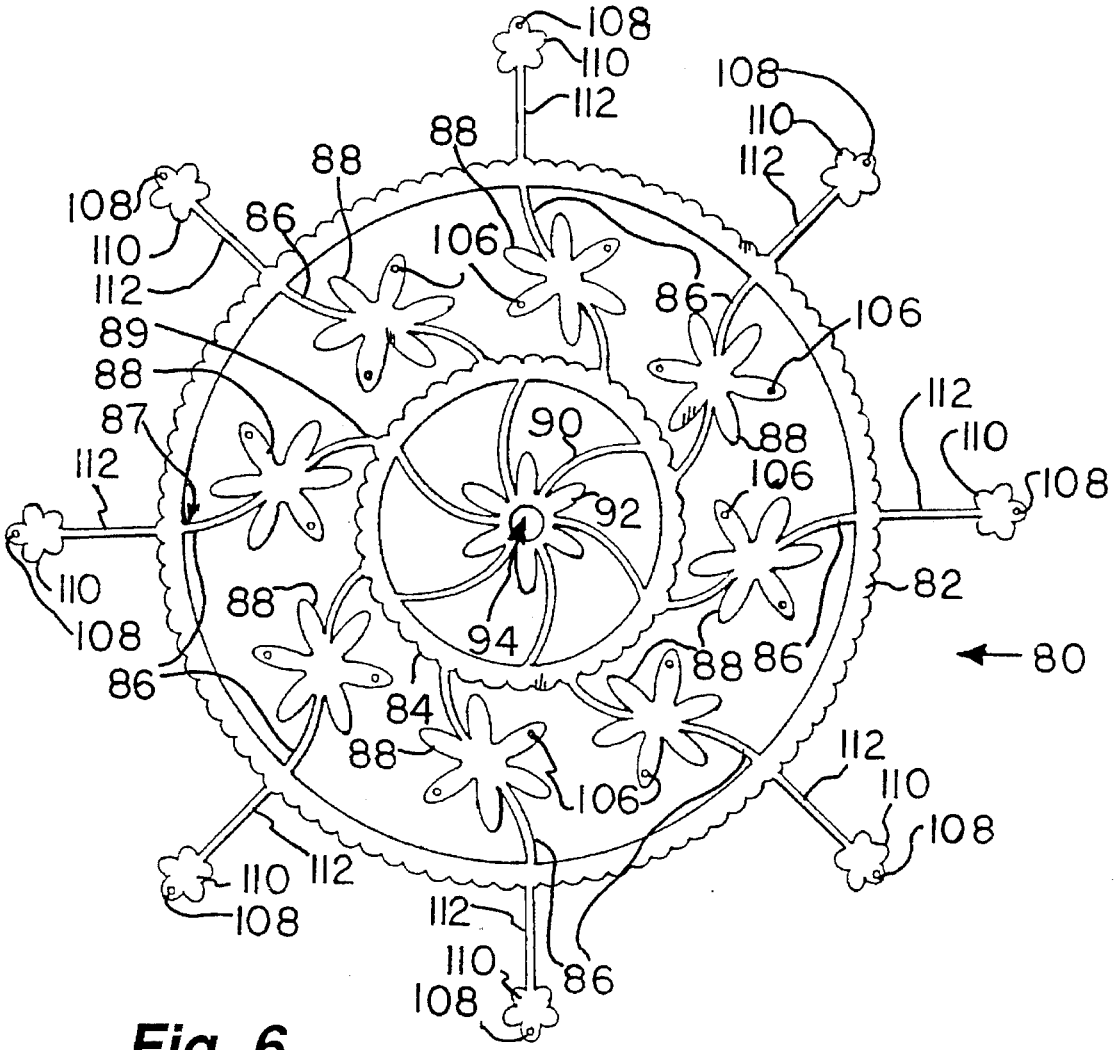
FIG. 6 is a plan view of a frame member according to an another embodiment of this invention.
Figure 7:
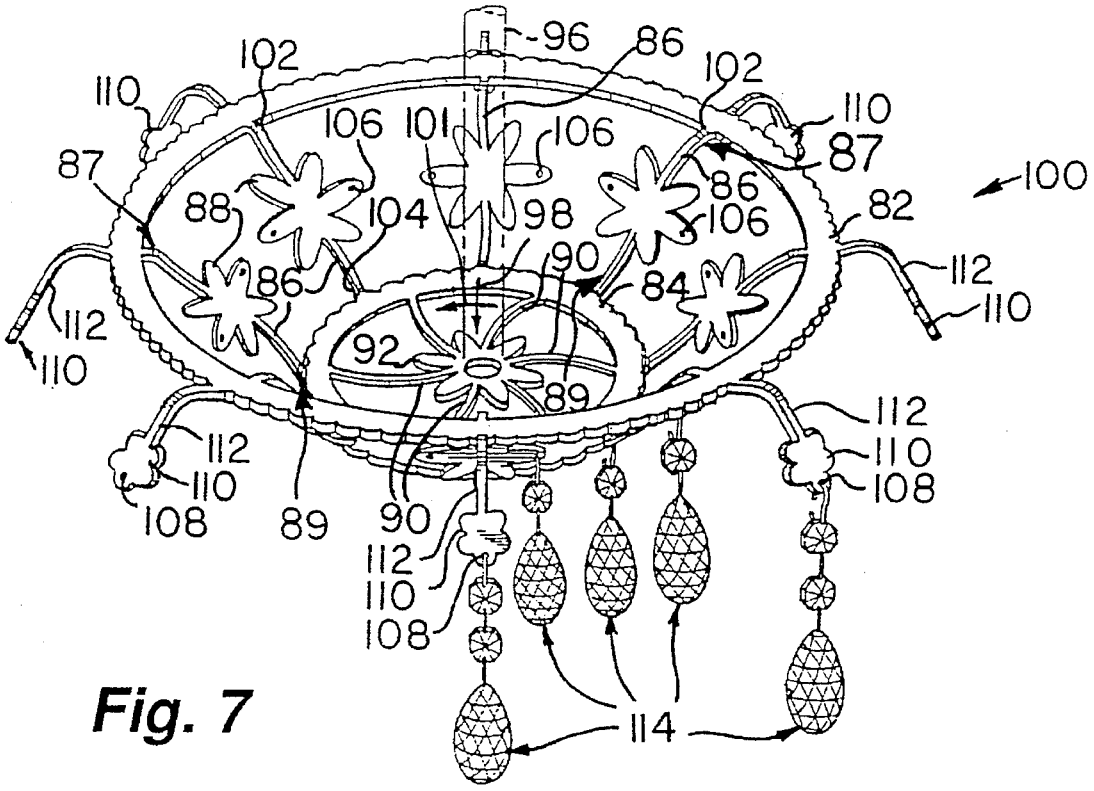
FIG. 7 is a perspective view of a chandelier frame formed from the frame member of FIG. 6.

The basic embodiment illustrated in FIGS. 3–5 of a pair of concentric rings spaced by integral arms can be made more elaborate and ornamental. FIGS. 6–7 illustrate one such structure in which a member 80 is cut from flat sheet stock into an elaborate shape having a pair of stylized concentric rings 82 and 84 with S-shaped arms 86 interconnecting the outer and inner rings 82 and 84, respectively. Each S-shaped arm includes an enlarged floral element 88 located along its length. The ends of the arms 86 are non-radially aligned. The inner ring 84 also includes an additional set of curved spokes 90 that converge at a flower shaped center 92 having a hole 94 therethrough. The hole 94 according to this embodiment provides an aperture for locating a center rod of a chandelier such as the rod 96 illustrated in FIG. 7.

With further reference to FIG. 7, formation of a three-dimensional chandelier frame structure 100 according to this embodiment is substantially similar to that discussed with reference to FIGS. 3–5. An axially directed downward, or "separating," force (arrow 98) is applied between outer and inner rings 82 and 84, respectively, while a rotational force (arrow 101) is provided between the rings 82 and 84 in order to make the S-shaped arms 86 substantially perpendicular to the planes of the rings. The arms 86 define a curving S-shape. Thus, they do not trace a straight line between their ends 87 and 89 upon frame formation. However, the arm ends 87 and 89 are oriented into a line that is approximately perpendicular to the line defined by each of the rings 82 and 84.

As discussed above, the arms 86 according to this embodiment are wider in the middle since they include a floral pattern 88. The ends 87 and 89 of the arms are still sized narrowly to allow a rapid bend 102 and 104 to be formed at each end. In this embodiment, holes 106 and 108 are provided on the flowers 88 and a set of floral extensions 110 that radiate outwardly from the outer ring 82. As depicted, the flower extensions 110 include elongated shafts 112 that can be bent into a desired shape as illustrated in FIG. 7. In this embodiment, the holes 106 and 108 are used to mount ornament strings 114 that comprise crystal drops according to this embodiment. Hence, unlike the prior art frame described above, holes can be provided to this frame without the use of separate tabs.

In the formation of the frames 64 and 100 as illustrated in FIGS. 3–5 and 6–7, respectively, it is contemplated that the unfinished flat frame member is held in a form such as a mandrel or armature and that ring separating force and rotational force can be applied in a metered amount to evenly translate the concentric rings from one another. Depending on the material used for the frame member, and its thickness, the formation process can be accomplished with bare hands according to this invention. However, for ease and speed of construction, it is contemplated that such forming is accomplished generally by means of a mechanical or automatic mandrel.

Figure 8:
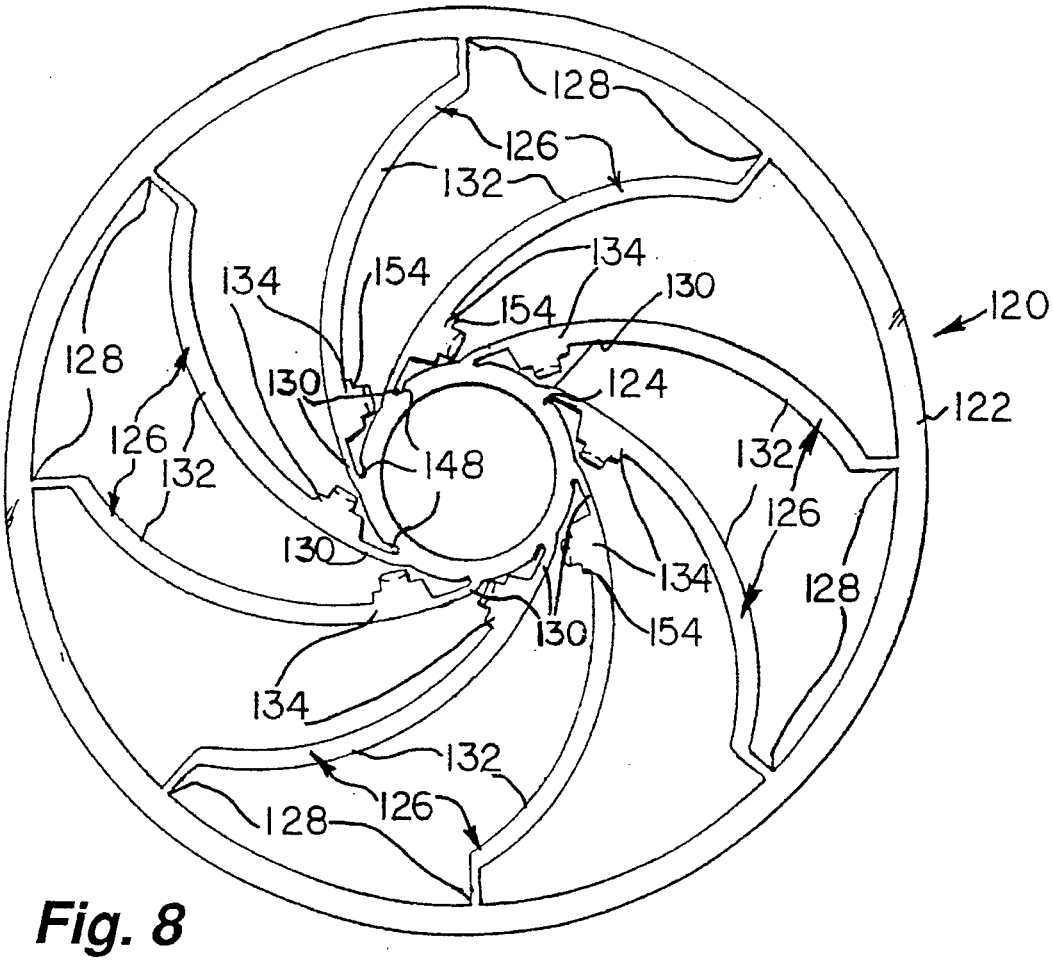
FIG. 8 is a plan view of a frame member according to another embodiment of this invention.
Figure 9:
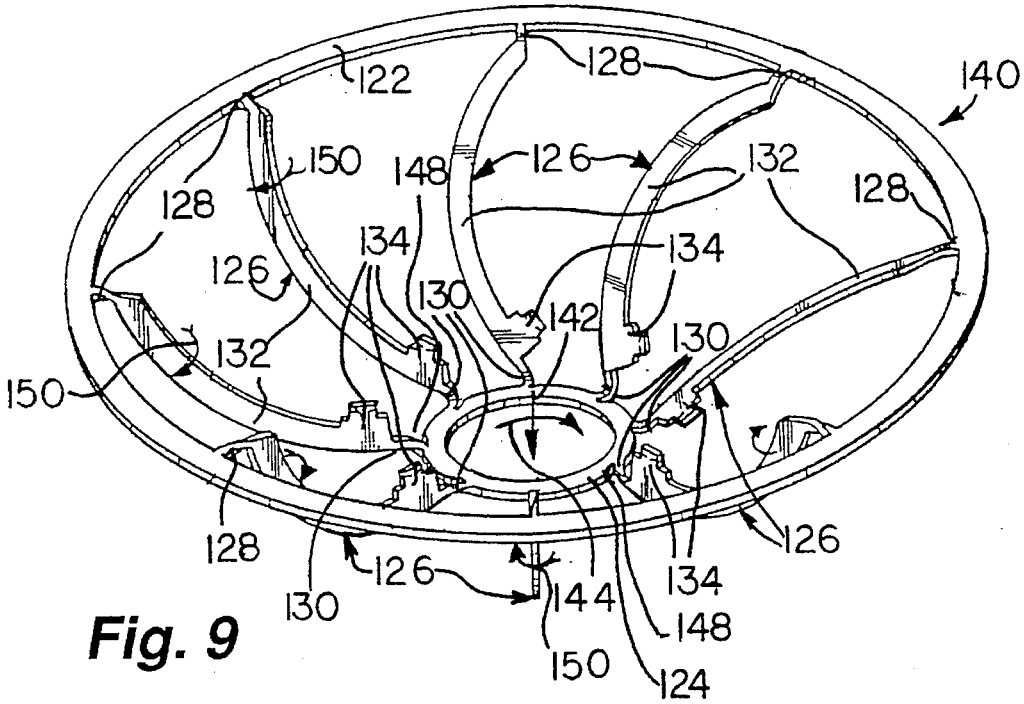
FIG. 9 is a perspective view of a partially-completed chandelier frame formed from the frame member of FIG. 8.
Figure 10:
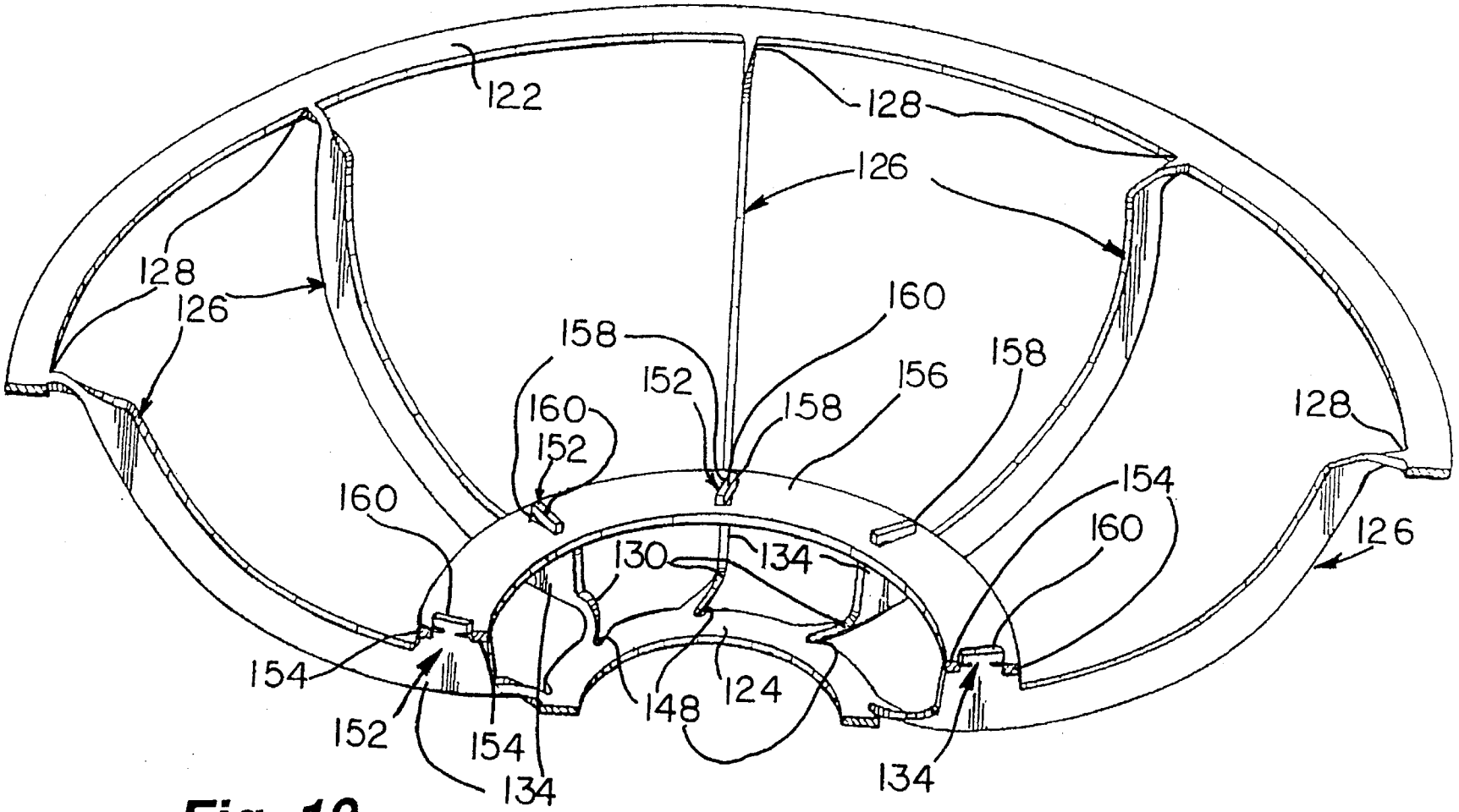
FIG. 10 is a partial cross-section of a fully-completed chandelier frame taken along line 10—10 of FIG. 9.

FIGS. 8, 9 and 10 illustrate another embodiment of a chandelier frame formed by plastic deformation of arms via application of spreading force and rotational force between concentric rings according to this invention. FIG. 8 shows a flat frame member 120 comprising an outer ring 122 and an inner ring 124 according to this embodiment. The inner and outer rings 122 and 124 are separated by a plurality of arms 126 that include narrow end sections 128 and 130 located adjacent each of the outer and inner rings 122 and 124, respectively. Each of the arms 126 further includes an enlarged midsection 132 that is curved according to this embodiment. Proximate the inner ring 124, each enlarged midsection includes a raised tab structure 134, the function of which is described further below.

FIG. 9 illustrates the manner in which a three-dimensional frame structure 140 can be formed from the substantially flat frame member 120 according to this embodiment. The method of formation is essentially similar to that described for the embodiments of FIGS. 3–7. A separating force (arrow 142) is applied to axially spread the inner and outer frame members 122 and 124 while a rotational force (arrow 144) is applied to bring the ends 128 and 130 of the angled arms 126 into a perpendicular orientation relative to the respective planes defined by the outer and inner rings 122 and 124. Note that the midsections 132 of the arms 126 are substantially more rigid than the narrow ends 128 and 130, due to their enlarged width. Accordingly, a rapid curving bend is naturally concentrated at the ends 128 and 130. As in other embodiments described herein, the ends 128 and 130 are formed with a width that is approximately equal to the thickness of the sheet stock. Hence, the ends 128 and 130 define an approximately square cross-section according to this embodiment. The length of the ends 128 and 130 should be at least two to three times the thickness of the material according to this embodiment (preferably, at least 0.2 inch) to insure that an adequate bend is formed without undue stress concentrations that could cause the frame to fail. In this embodiment, the inner ring includes a series of cuts 148 that enable the desired length of end 130 to be provided while maintaining the tab structures 134 and wider arm midsections 132 closer to the inner ring 124.

Figure 11:
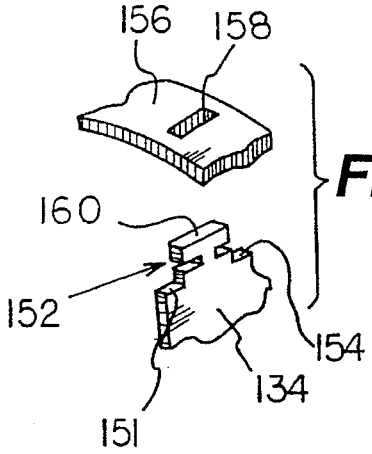
FIG. 11 is an exploded, partial perspective view of a locking ring slot and tab structure for the chandelier frame of FIG. 10.
Figure 12:
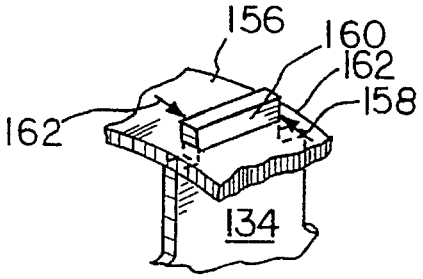
FIG. 12 is a completed slot and tab interconnection according to FIG. 11.

Unlike the prior embodiments described herein, the widened midsections 132 of the arms 126 are twisted (arrows 150) so that their widthwise direction is aligned radially relative to a center axis of the rings. In this manner, the curved arms 126 give the frame 140 a bowl-like shape as depicted in FIG. 10. The twisting motion (arrow 150) as shown in FIG. 9 places the tab structures 134 into an upright position in which the tab 152 of the structure 134 are aligned parallel to the axis of the rings 122 and 124. The tab structure 134 is further detailed in FIGS. 11 and 12. Each tab structure 134 further includes a base structure 154 that is substantially flat according to this invention. The tab structures 134 are constructed so that a locking ring 156 having a plurality of slots 158 disposed radially about its circumference, can be seated over the tabs 152 (FIG. 11). Once seated, the head 160 of each tab 152 is forcibly rotated (arrow 162) into a permanently deformed position as shown to lock the ring 156 relative to the arms 126 (FIG. 12). In this manner, a strong secured frame 140 is formed.

Each of the above-described embodiments relates to the formation of at least two axially spaced concentric rings connected by integrally attached arms. By rings, it is meant to mean any substantially flat structure that forms a closed loop about its perimeter including complex geometric shapes with structures that project inwardly and outwardly. To wit, the teachings of this invention can be applied to non-closed structures as well to form, for example, half baskets and wall sconces. Hence, as used herein, the term "ring" shall refer to such structures as well, and to any structure that, at least partially, surrounds a point.

It should be further noted that each of the above-described embodiments, while showing only two axially spaced rings, can comprise any number of axially spaced rings joined by integral arms. Typically, an increasing or decreasing-diameter tiered structure is contemplated since, in order to form interconnected rings and arms from a flat sheet, it is generally necessary to cut rings and arms that radiate continuously outwardly from each other. The resulting structure would, thus, form a plurality of continuously increasing or decreasing-diameter rings in a tiered arrangement.

Figure 13:
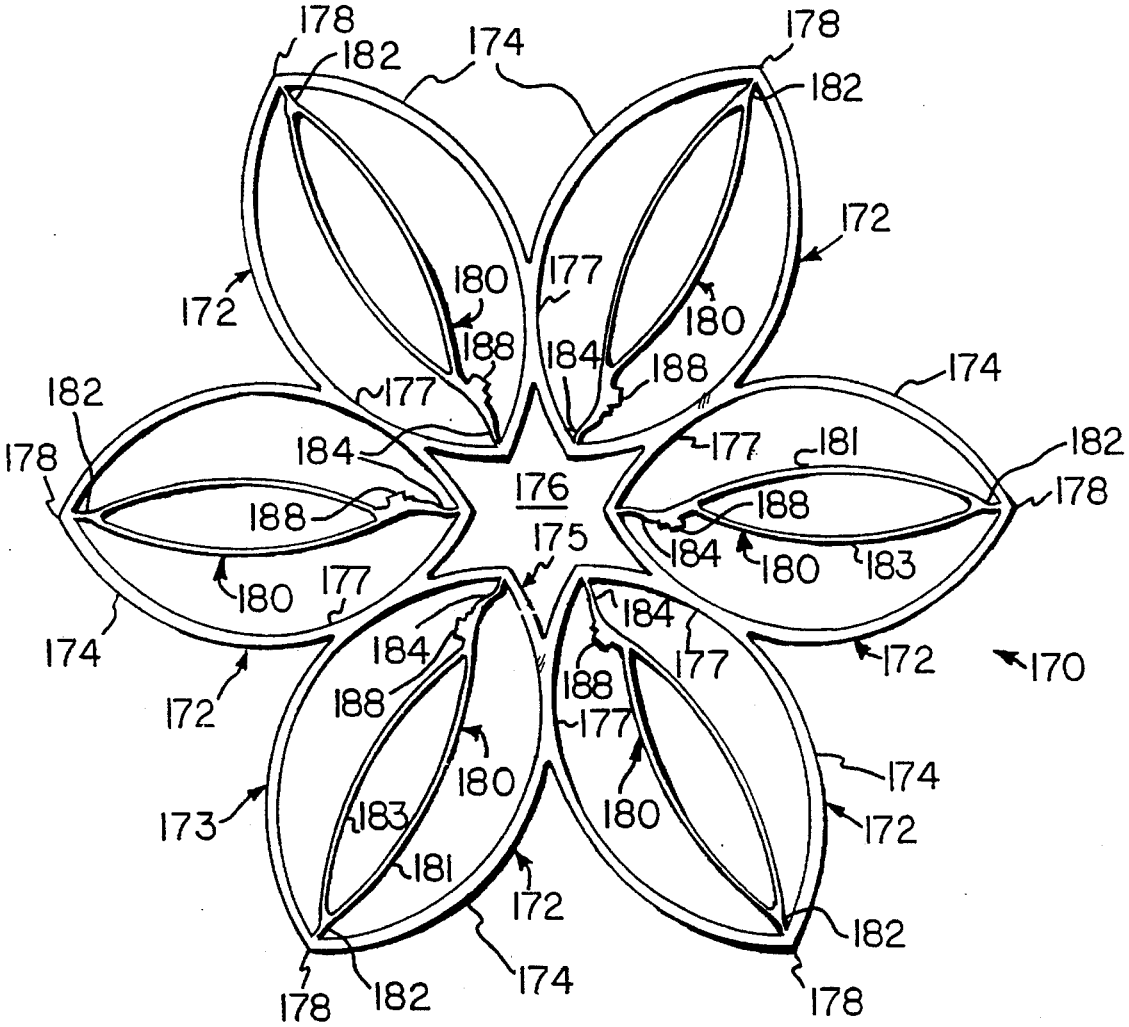
FIG. 13 is a plan view of a frame member according to another embodiment of this invention.

FIG. 13 illustrates a frame member 170 that can be used to form a three-dimensional frame structure from an otherwise flat member according to an alternate embodiment. The member 170 is constructed from a flat piece of sheet stock using laser cutting or similar forming techniques according to this invention. The sheet can comprise 0.074 inch fully hardened steel sheet or another similar plastically deformable material. The member 170 is constructed to include a plurality of ovular loops or "petals" 172 defining an overall flower-like outline. Each petal includes an outer ovular frame 174 wherein each of the frames 174 converge to form a star-like center 176. Opposite the center 176, each petal frame 174 defines a radially outermost point 178. Alternatively stated, the frame member 170 defines two radially undulating concentric rings, joined by intersecting arms. The outwardly exposed portions of the petals 172 define the outer ring 173, while the inwardly directed portions define the inner ring 175 that traces the star-like center 176. The outer ring 173 and inner ring 175 are joined at various locations about the circumference by intersecting arms 177.

Between the center 176 and each outermost point 178 of the frame member 170 spans an inner arm that defines a loop 180 comprising a pair of legs 181 and 183 that are connected to the petal frame 174 by a pair of narrow runners 182 and 184. As further detailed in FIG. 14, each loop 180 includes runners 182 and 184 that are sized in width and length to enable rotation of the loops 180 relative to the petal frames 174. Such rotation is depicted by arrows 186. Hence, like the embodiment of FIGS. 8–12, the frame member 170 of FIGS. 13–14 includes arm-like structures that extend between two points and are adapted to be twisted into an orientation that is transverse relative to the plane defined by the remaining frame member (in this example, a plane defined by the petal frames 174). The twist formed in each of the runners 182 and 184 can be termed "plastic and asymmetric deformation" according to this invention, since the distribution of material across the width of each runner is uneven, unlike a bend along one axis. As described above, the runners 182 and 184 should be at least 2–3 times the thickness of the sheet material (0.2 inch) in length and should have a width therealong that is approximately equal to the sheet material thickness (0.074 inch).

Also like the embodiment of FIGS. 8–12, each loop 180 includes a tab structure 188 located adjacent an inner end of the petal 172 relative to the center region 176. Rotation of each of the loops places the tab structure 188 in an upright position aligned substantially in a plane transverse to a plane defined by the undeformed petals 172. The tab structures 188 are, thus, in a position, following plastic deformation of the loop runners 182 and 184, to receive a locking ring such as that illustrated in FIGS. 10–12. Such a locking ring could be sized so that it simply lays over the flat frame structure depicted in FIG. 14. However, it is specifically contemplated, according to this embodiment, that the locking ring includes slots that are positioned radially inwardly relative to the radial location of the tab structures 188.

Figure 15:
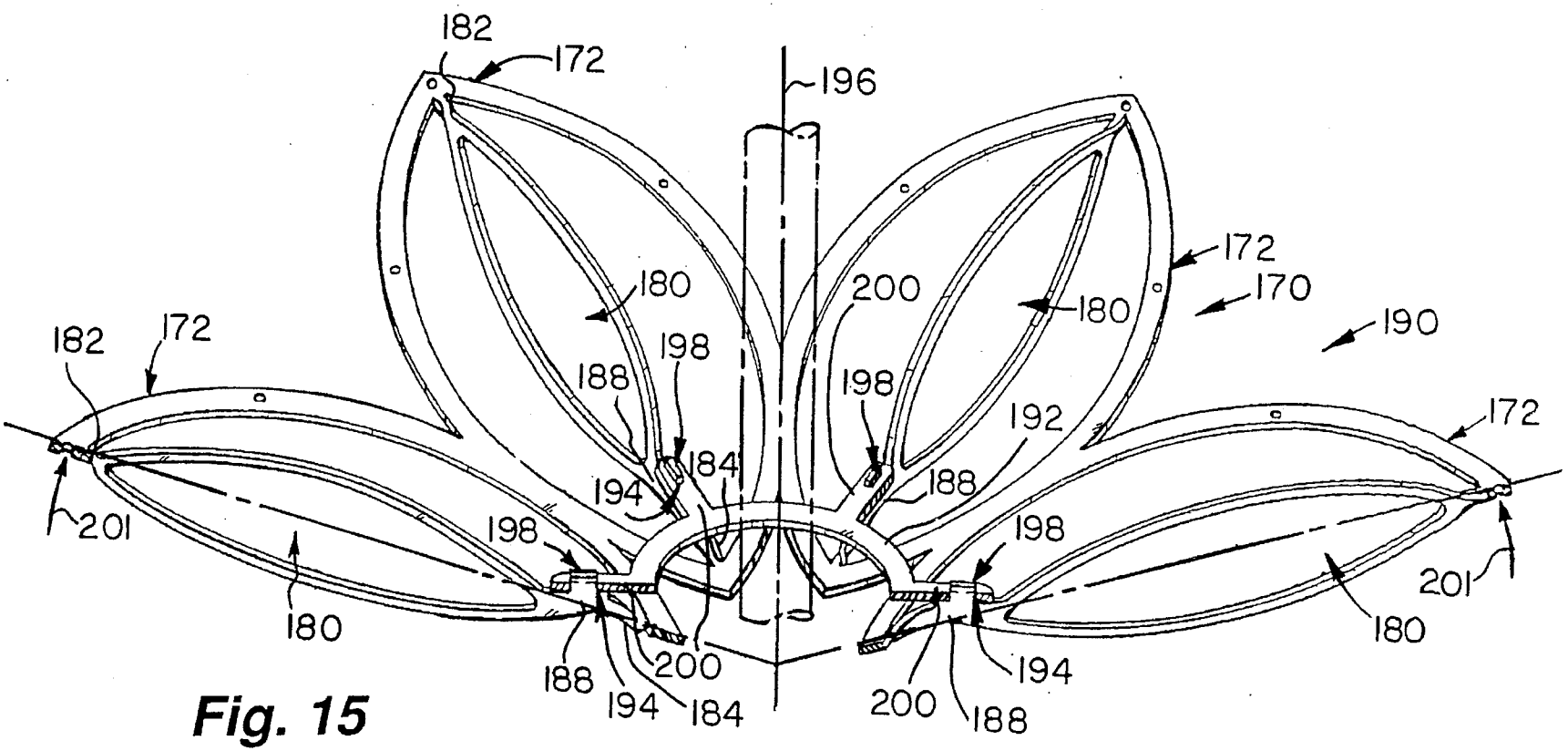
FIG. 15 is a partial perspective view of the frame of FIG. 14 illustrating a subsequent formation step utilizing a locking ring.

An assembled chandelier frame 190, formed using the frame member 170 in conjunction with a locking ring 192, is depicted in FIG. 15. Since the locking ring 192 includes slots that are spaced radially inwardly (taken from the center axis 196) of the tabs 198 when the frame member is flat, the frame member 170 must be bent so that the tabs 198 are moved radially inwardly (arrows 210) into alignment with the slots 194 of the locking ring 192. Accordingly, when the tabs 198 engage the slots 194, the frame member 170 is deformed into a bowl-like shape. So long as the radial location of the slots 194 is chosen to prevent bending of the frame member 170 beyond its elastic limit, the frame member will remain non-permanently or "elastically" deformed and, upon removal of the locking ring 192, can return to a substantially flat shape wherein the petals 172 lie substantially within a plane. The locking ring 192 according to this embodiment includes slots positioned on radial extensions 200. However, it is contemplated that the ring can comprise any shape and the slots can be positioned at any sufficiently sturdy location thereon.

Figure 15A:
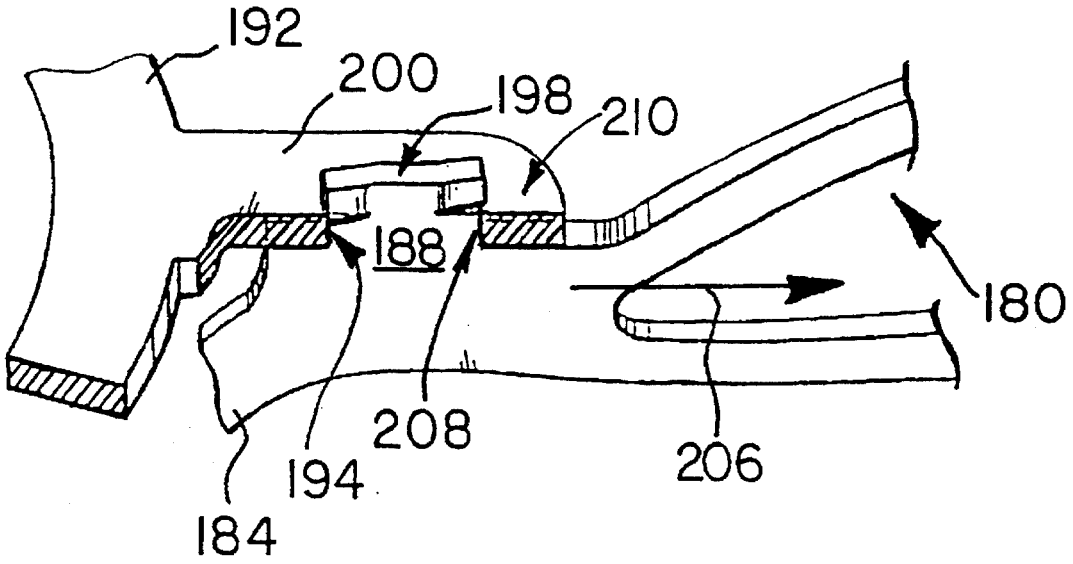
FIG. 15A is a detailed fragmentary, perspective view of an interconnection between the locking ring and frame member according to FIG. 15.

The interlocked ring and frame member cause the frame member to store deformation energy in the manner of a spring. Accordingly, the interconnection between each of the tabs 198 and walls of the slots 194 are under tension. FIG. 15A details the interconnection between the shaft 204 of the tab 198 and the slot 194 of extension 200. The spring energy stored in the frame member generates a force in the tab structure 188 directed away from the extension 200 as shown by arrow 206. Hence, the interconnection 208 between the radially outward slot wall and opposing thickness edge of the tab experience the greatest force concentration. Hence, the area 210 on the extension 200 radially outward of the slot 194 should have a sufficient length and width to insure that no deformation occurs due to the tension applied by the frame member. It should be noted, that the spring tension exerted by the frame member is increased when the frame member is provided with a plurality of heavy ornaments. Hence, the exact width of radially outward area 210 should be sized to account for the spring tension and added weight of ornaments.

An advantage of the attachment arrangement according to this embodiment is that the spring tension and ornament weight are resolved into a force component directed against the locking ring 192 as depicted by arrow 206. Essentially no force is directed perpendicular to this arrow. Thus, the spring tension and ornament weight do not apply any direct force against the twisted tab heads. Rather, all force is directed transversely to the tab heads, in a direction that the tabs 198 have maximum strength.

Since the frame member is locked by the ring under spring tension, it exhibits relatively high precision. This is because the frame member is prestressed into a final shape that it tends to retain, regardless of application of external forces by, for example, wind or vibration. As such, ornaments are held in an accurate relationship relative to each other enhancing the optical effect of the finished chandelier. As in the other above-described embodiments, assembly of a chandelier frame according to this embodiment can be accomplished by hand, bending the loops 180 into approximate perpendicular shape and then final bending the entire frame elastically to attach the locking ring. Alternatively, assembly can be accomplished mechanically by means of a robot assembly unit or other appropriate device.

A set of spokes and center ring can be provided to the locking ring 192 of this embodiment in order to mount a center post of a chandelier. However, as noted above, it is desirable to minimize the force applied against a twisted tab head according to this embodiment. Otherwise, the weight of a fully loaded chandelier frame could cause the locking ring 192 to break free of the twisted tabs by forcibly realigning them with the slots. One possible solution to this problem is to weld or solder the locking ring to the tabs. However, this slows construction. Similarly, a second ring can be provided below the frame member 170 and the upper locking ring and lower ring can be sandwiched together using bolts. Hence, most of the load would be taken up by the lower ring, relieving force between locking ring 192 and tabs 198. Alternatively, the locking ring can be located on tabs oriented toward the bottom of the bowl. In this manner, the force of load bearing would be directed away from the tab heads and into the main body of the tab structures 188. According to this invention, some of the loops 180 can be directed so that their tabs face opposite other of the tabs in the frame. Accordingly, a plurality of locking rings on axially remote portions of the frame (top and bottom in this example) can be attached to the frame member.

Figure 16:
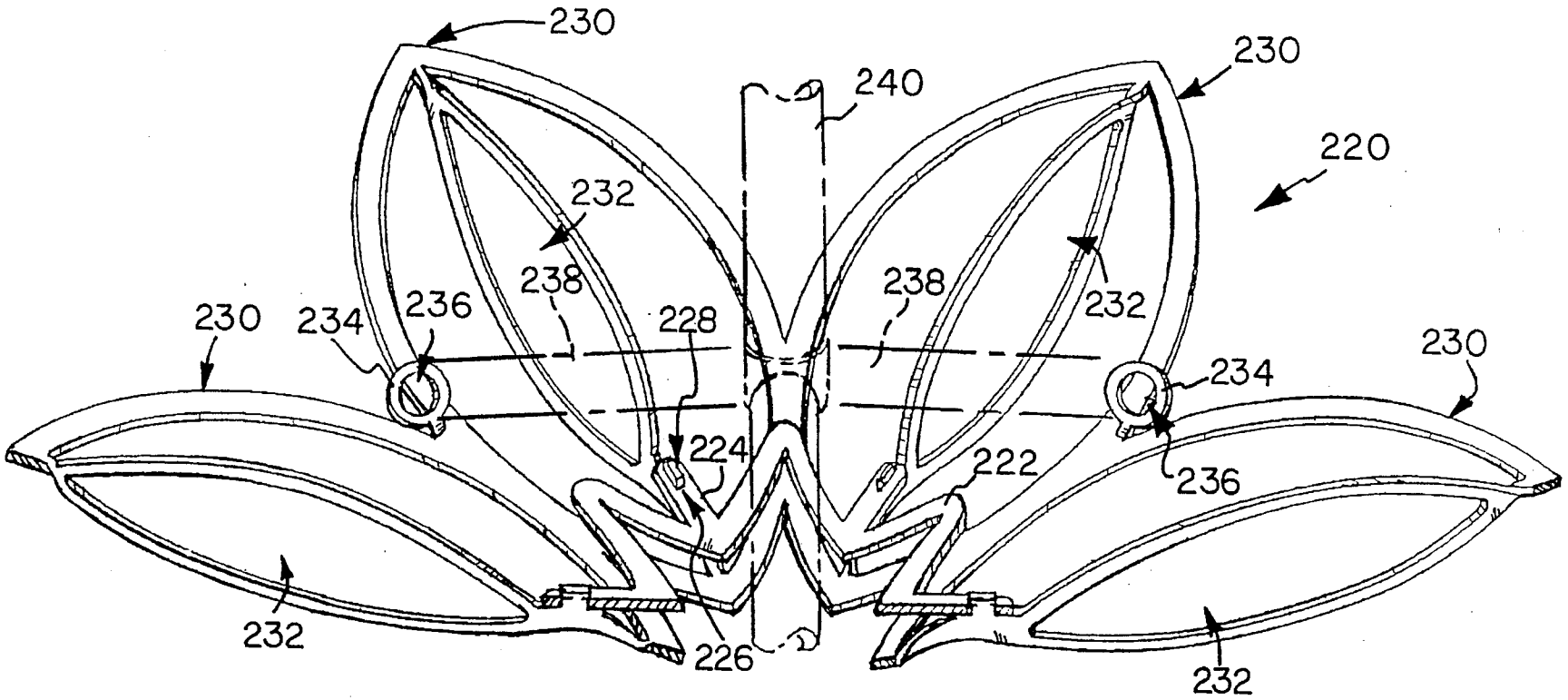
FIG. 16 illustrates an another embodiment of a chandelier frame, according to FIG. 14, utilizing a locking ring and separate arm supports.

FIG. 16 illustrates one preferred embodiment in which potential strength problems resulting from a locking ring-to-center post interconnection are avoided. The frame 220 includes a locking ring 222 shaped substantially like a star with extensions 224 and 226 that interengage tabs 228. The frame 220 defines petals 230 like those illustrated in the embodiment of FIGS. 13–15. The locking ring 222 holds the frame in an elastically deformed bowl-shaped relation by interengaging with the tabs 228. These tabs 228 are formed on loop-like arms 232 also similar to those described above. In this embodiment, the frame 220 is supported on a center post 240 by means of arm supports 234 that are formed integrally with the petals 230 as part of a flat frame member. The arm supports 234, according to this embodiment, are bent upwardly so that the arms 238 can pass therethrough. Such bending can be accomplished automatically or by hand according to this invention. In other words, the supports 234 are cut at the same time on the same sheet as the petals 230 according to this embodiment. The supports 234 include holes 236 that are sized to engage tubular chandelier arms 238 (shown in phantom) commonly utilized in chandelier designs to carry lights. The arms 238 are attached to a central post or axis 240 according to this embodiment.

By supporting the frame 220 on its petals, rather than the locking ring, undesirable transverse force applied against the tab heads is avoided. Rather, essentially all force is directed as shown in FIG. 15A and the load of the frame and its ornaments is taken up directly by the arms 238 which can be sized and constructed to support such a load.

Figure 17:
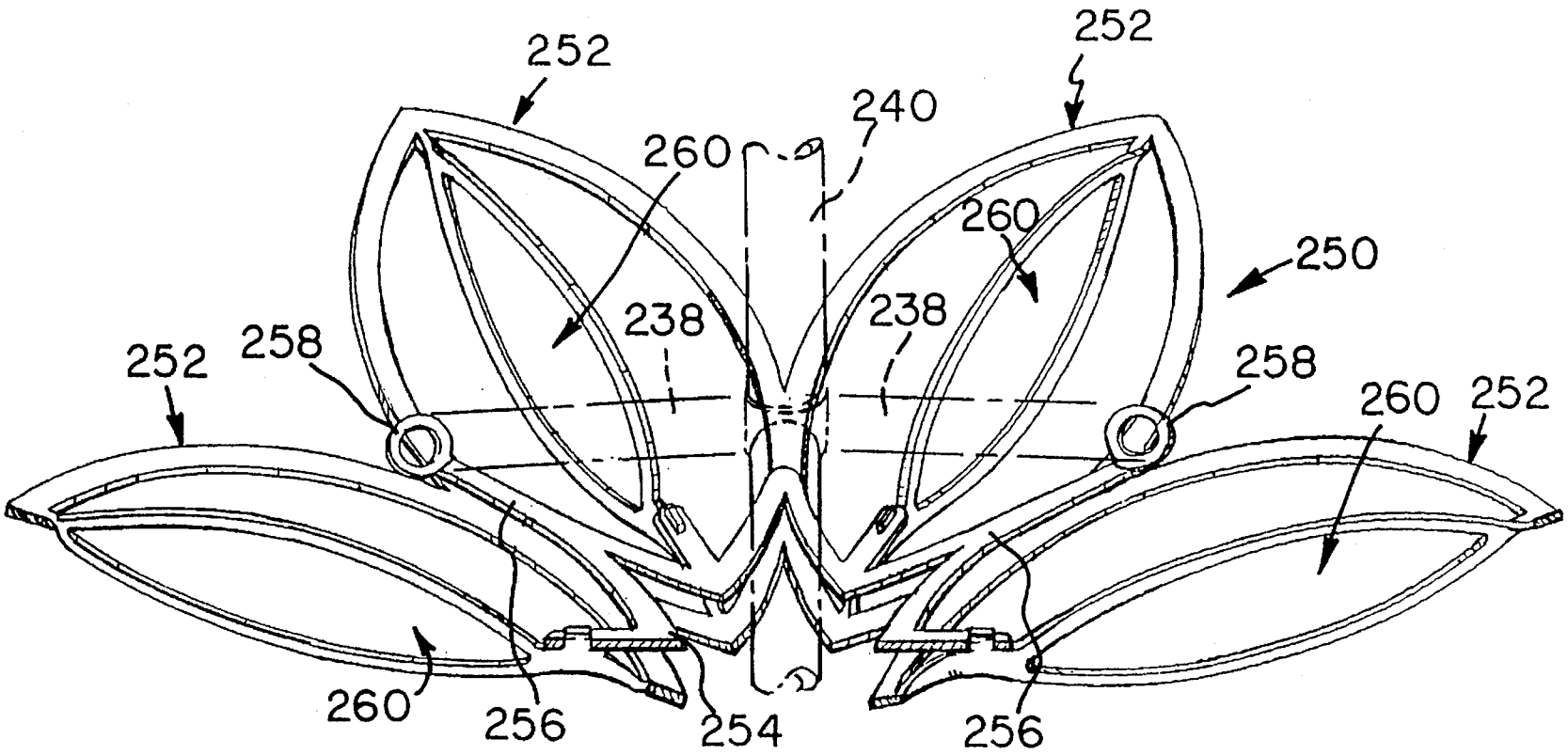
FIG. 17 is yet another embodiment of a chandelier frame, according to FIG. 14, incorporating arm supports on the locking ring.

FIG. 17 illustrates an alternate embodiment of a chandelier frame 250 according to this invention. The frame 250 is substantially similar to the frame 220 of FIG. 16. This frame is also supported on a pair of arms 238 interconnected to a center post 240. However, the petals 252 of the frame member include no arm support loops. Rather, the locking ring 254 includes extensions 256 having arm supports 258 located at ends thereof. Like the supports 234 of FIG. 16, the supports 258 of this embodiment are bent upwardly from an originally flat orientation. The arm supports are, thus, oriented to allow the arms 238 to pass therethrough. The locking ring 254 having loops 258 according to this embodiment can be utilized in certain embodiments where a low-weight frame is contemplated. Alternatively, the locking ring can be welded or soldered to the petals 252 for enhanced strength. Similarly, the locking ring 254 can be positioned in an opposing location, beneath the frame, so that the load is absorbed by the petal arms 260. For higher weight applications, the embodiment illustrated in FIG. 16 is generally preferred.

Figure 14:
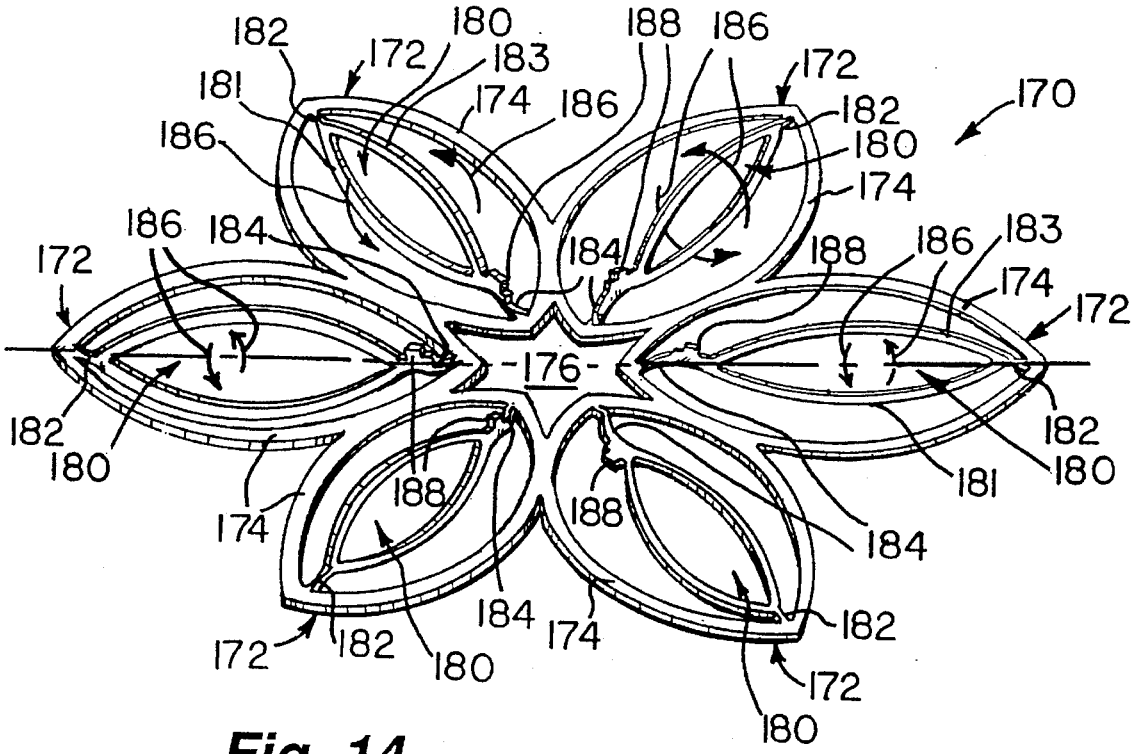
FIG. 14 is a perspective view of the frame member of FIG. 13 illustrating an initial frame formation step.
Figure 18:
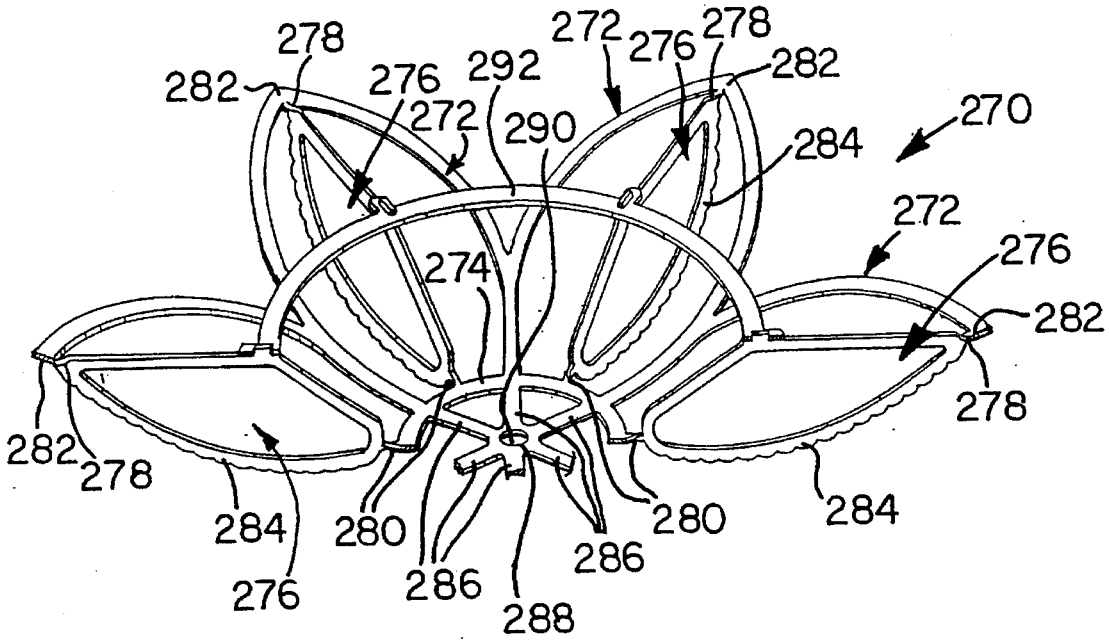
FIG. 18 is a partial perspective view of another embodiment of a chandelier frame held in spring tension by a large-diameter locking ring.

Each of the above-described embodiments, as illustrated in FIGS. 13–17, entail the use of a plurality of petals that define an open center, such as the star-like center 176 in FIGS. 13 and 14. The open center relieves stress concentrations that would normally form if the petals were joined proximate a central axis. In many applications, the stress concentrations at the center could cause buckling of the flat frame member along its length during formation. However, for certain applications, it is possible to form a small diameter center section on the chandelier frame. FIG. 18 illustrates a frame 270 having a plurality of petals 272 located about a center ring 274. The petals each include an internal loop or arm 276, wherein the arm 276 is joined by runners 278 and 280 to a point 282 on the petal 272 and the inner ring 274, respectively. The arms are twisted so that they are aligned along a plane transverse to a plane of the petals 272. To this end, the runners 278 and 280 are sized in thickness and length as described above. The lower leg 284 of each loop-like arm 276 includes a scalloped shape according to this embodiment. Note that, according to this invention, the twistable arms can comprise any number of legs, including only one, and can be constructed with a variety of ornamental shapes and designs thereon. It is, however generally desirable that this plastically deformed arm include a structure for engaging a locking ring in a perpendicular relationship thereto.

In this embodiment, the center ring 274 includes a plurality of spokes 286 that converge at a center section 288 having a hole 290 therethrough. The hole according to this embodiment is contemplated for mounting a center post of the chandelier thereto. In this manner, the main frame member of the chandelier includes a load-bearing member for supporting the weight of the chandelier, thus removing load-bearing stress from the locking ring 292. In this embodiment, the locking ring 292 is sized substantially greater in diameter than the locking rings of the preceding embodiments. As a practical matter, a locking ring can be located variably along the radius of the frame. The locking ring need only be located so that it interengages with appropriate structures on the arms 276. As noted above, while this embodiment includes a center section having a hole 290 for mounting a chandelier post therethrough, this center section may induce undesirable stress concentrations to the frame. Thus, this embodiment can be limited to certain applications, whereas the above-described embodiments having an open center section are more freely deformable into a deep bowl-shape.

Figure 19:
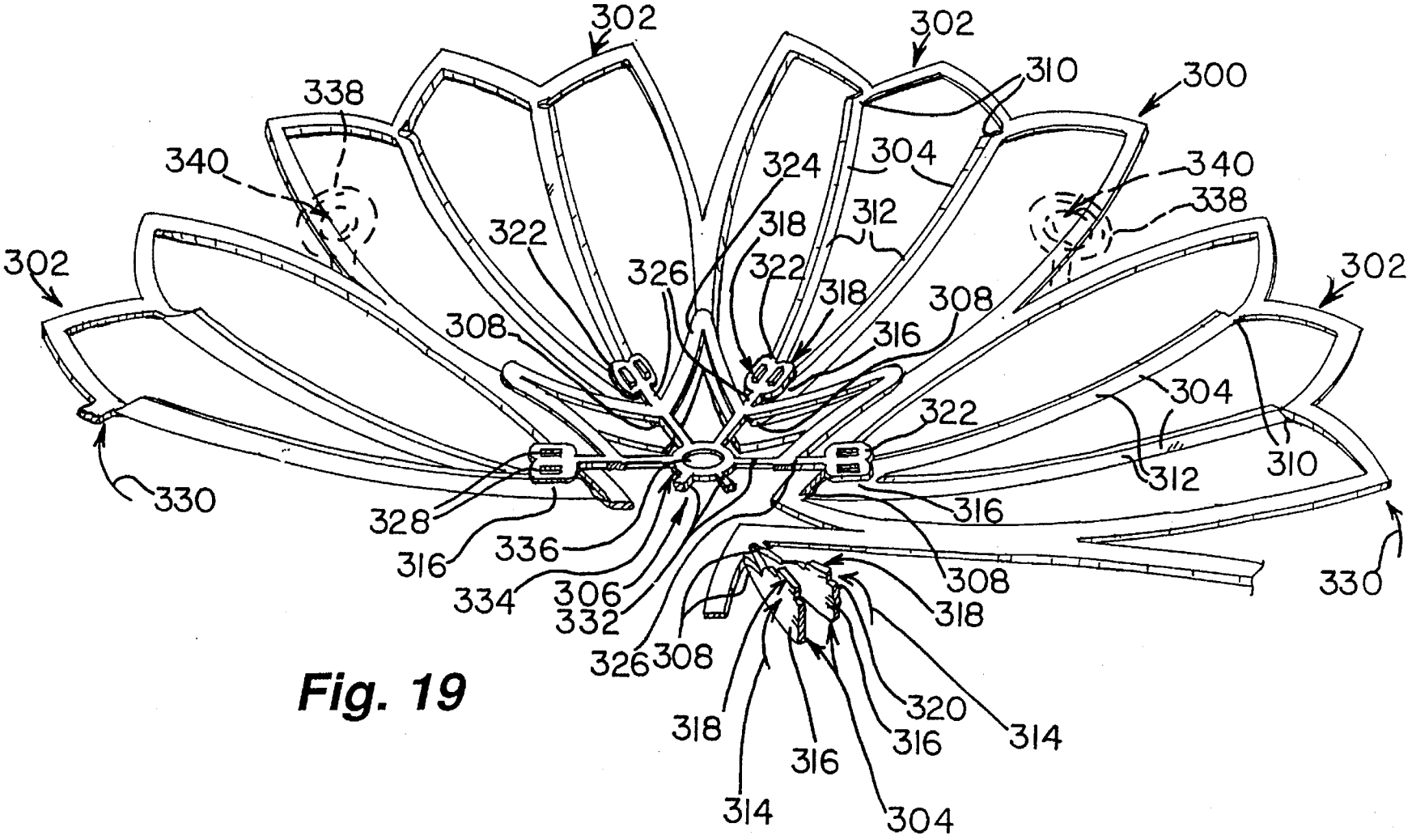
FIG. 19 is a partial perspective view of another embodiment of a chandelier frame having a plurality of plastically deformable members positioned adjacent each other.

As discussed above, the "loops" or "arms" of the preceding embodiments can have more or less than two legs according to this invention. FIG. 19 illustrates a frame 300 having petals with a fan-like end structure rather than a single point. Within each of the petals 302 are positioned a pair of arms 304 that become increasingly spaced from each other in a radially outward direction from a center 306 of a frame 300. Each of the arms 304 according to this embodiment comprise a pair of runners 308 and 310 having a width and length sized, as described above, to allow a rapid twist according to this invention. The frame 300 of FIG. 19 defines a pair of separated arms 304 within each petal 302. The arms 304 are separated from each other substantially along their entire lengths, although they are closely adjacent to each other at the radially innermost runners 308.

The arms 304 are wider along their midsections 312 to provide enhanced structural strength and a more aesthetic appearance. As in the above-described embodiments, the arms 304 are twisted as shown by arrows 314 relative to the petals 302 to become plastically deformed and aligned with planes transverse to a plane defined by the petals in an unassembled, unstressed and flat state. Each of the arms 304 further comprises a tab structure 316 according to this invention. Each tab structure 316 includes a tab 318 and a flat base 320 adjacent the tab upon which a slot-carrying structure 322 of the locking ring sits. In this embodiment, the locking ring 324 defines a star shape having a set of slot-carrying structures 322 located at ends of extensions 326 that project radially outwardly from the ring 324. A plurality of locking ring structures are contemplated according to this invention. The locking ring structure 322 according to this invention includes a pair of slots 328 that are arranged to engage each of the adjacent tabs 318 of the arms 304. As in the above-described embodiments, the frame 300 according to this embodiment is formed by first twisting the arms 304 into a substantially perpendicular position relative to the petals (arrows 314), and then bending the petals 302 upwardly (arrows 330) in order to move the tabs 318 radially inwardly to engage the slots 328 of the structures 322. By twisting the tabs 318 out of alignment with the slots, the locking ring 324 and arms 304 are permanently joined. The frame 300 according to this embodiment includes a locking ring 324 having a plurality of spokes 322 that converge in a center section 334. The center section includes a hole 336 for mounting a chandelier post. The provision of multiple tab structures 316 enhances the load-bearing strength of the chandelier frame. Alternatively, a set of integrally formed arm supports 338 (shown in phantom) having holes 340 for receiving tubular arms can be provided between the petals at appropriate points. As in the other embodiments described above, the arm supports 338 can be formed as part of the flat frame member and plastically deformed into a substantially upright position so that the arms can pass through the holes 340.

Figure 20:
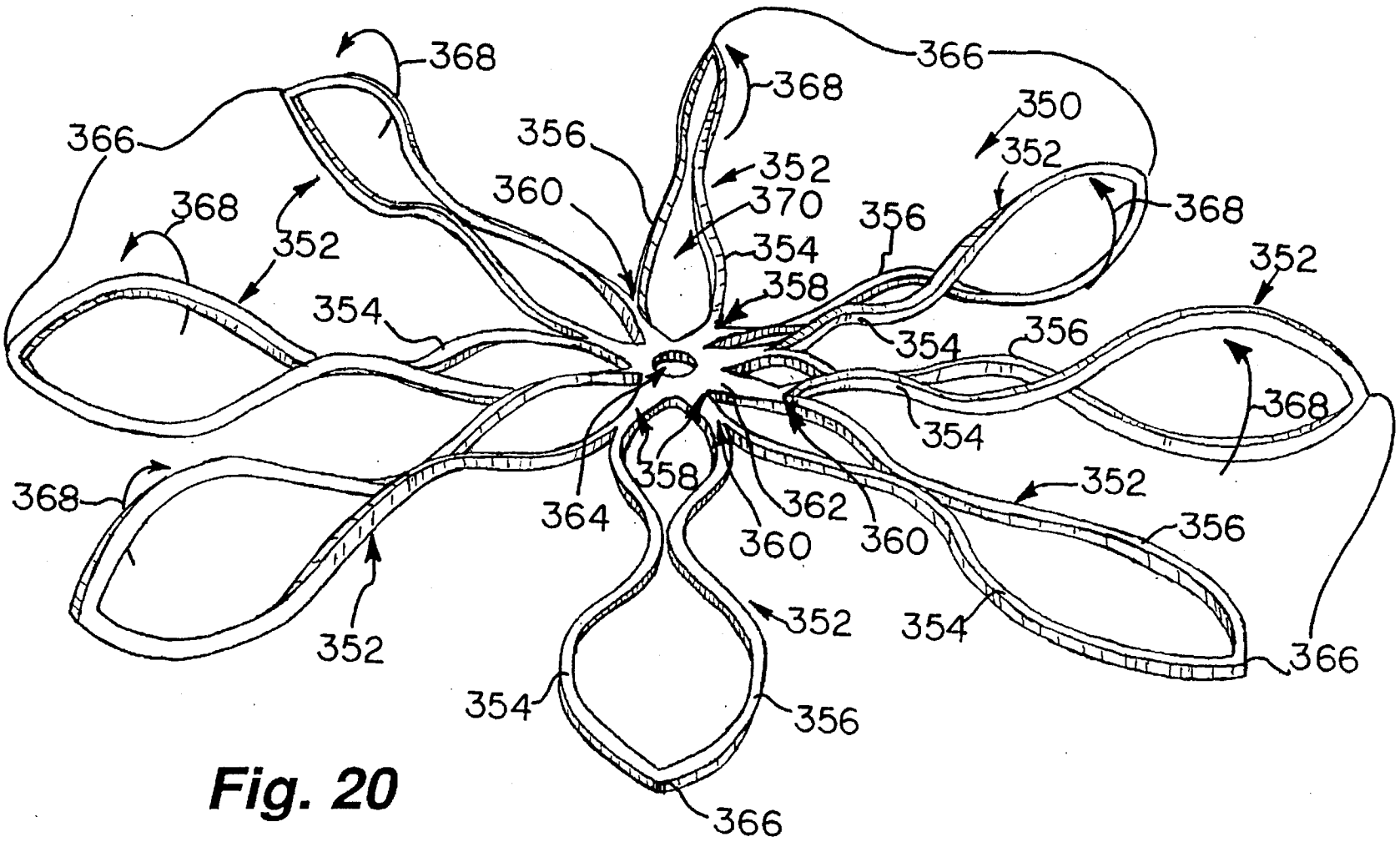
FIG. 20 is a perspective view of another embodiment of a chandelier frame including a pair of plastically deformable members that radiate from a center and join at a radially remote point to form arms having three-dimensional shapes.

FIG. 20 illustrates another alternate embodiment of a frame 350 wherein the arms 352 (or "petals") are twisted to form a fully three-dimensional frame structure from an ordinarily flat, substantially two-dimensional structure. Each of the arms or petals 352 comprises a pair of undulating legs 354 and 356 that are joined to circumferentially remote points 358 and 360 on a center structure 362. The center structure 362 includes a hole 364 that can be used in conjunction with a chandelier center post.

Each of the legs 354 and 356 extend radially outwardly to a connection point 366 according to this embodiment. Hence, each arm or petal 352 defines a closed loop. The frame 350 according to this embodiment is made three-dimensional by rotating the pair of legs 354 and 356 as illustrated by the arrows 368 so that the legs are brought out of the plane defined by the unbent frame and into an orientation that is approximately perpendicular to the plane. Since the legs 354 and 356 are circumferentially separated at their respective ends 358 and 360, the legs remain separate from each other, defining a space 370 therebetween, when brought into a perpendicular orientation. Accordingly, unlike the above-described embodiments in which a substantially planar arm is twisted so that it is aligned transversely to the plane of the remaining frame member, the arms 352 of this embodiment are twisted so that they define a length, a width and a height in each of three-dimensions. Hence, they become fully non-planar when taken as a whole. As in the other embodiments described herein, the radially outward portions of the arms 352 can be made thick so that they do not readily plastically deform upon twisting. As such, only the portion of the arm proximate the ends 358 and 360 requires a relatively narrow width to enable a twist to be formed therein.

Figure 21:
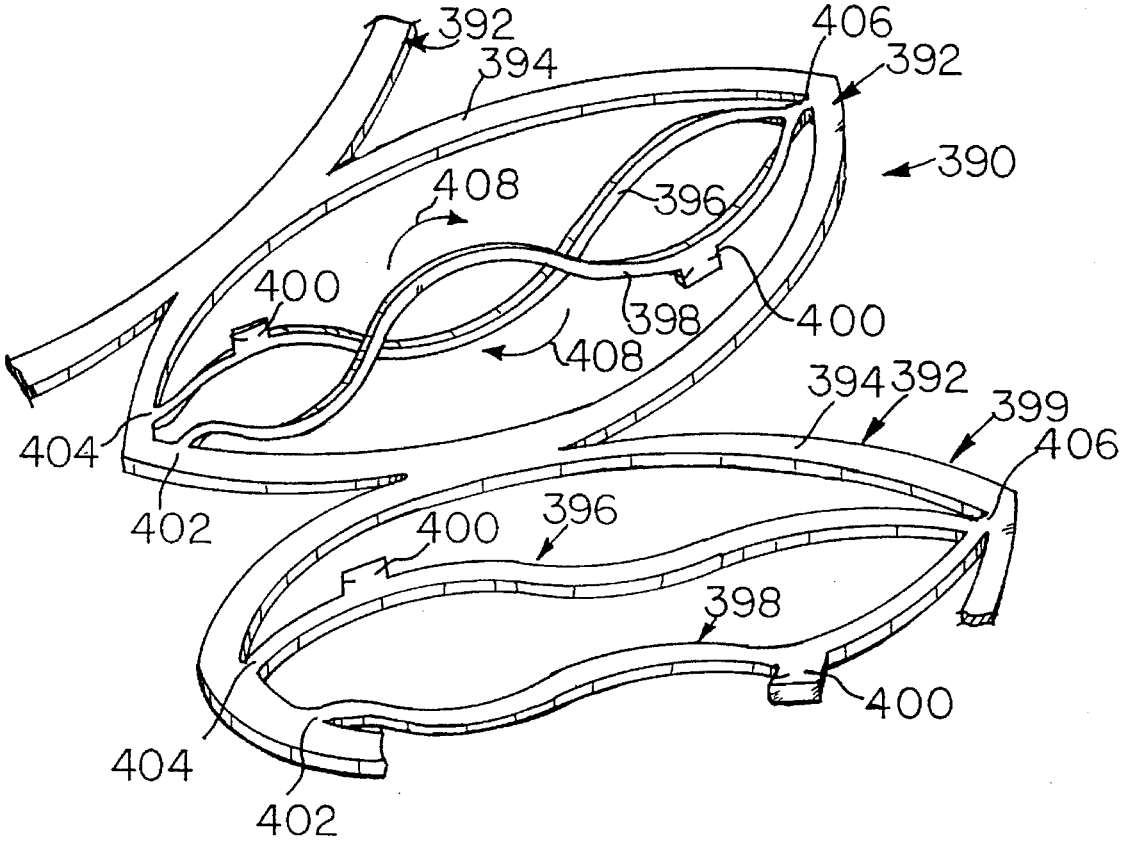
FIG. 21 is a partial perspective view of another embodiment of a chandelier frame having a pair of plastically deformable members that define a three-dimensional shape.

The frame 350 of FIG. 20 can, itself have some practical applications. However, the use of unsupported arms 352 somewhat limits the weight-handling capabilities of the arms. FIG. 21 illustrates one possible practical application for the arms according to the embodiment of FIG. 20. A portion 390 of a frame is shown, having a petal structure 392 defined by an outer petal frame 394 somewhat similar to that described above. The outer petal frame 394, according to this embodiment, includes a pair of undulating arms 396 and 398 that are formed as part of a flat sheet stock frame member according to this embodiment (flat petal 399). Each of the arms 396 and 398 can include a tab 400 or similar structure thereon for attachment of a locking ring or other chandelier frame components. The arms 396 and 398 are attached remote from each other at radially inward ends 402 and 404 and are joined to each other at a common runner 406 at a radially outward end. The arms 398 and 396 are rotated as shown by arrows 408 to produce a three-dimensional arm structure according to this invention. This three-dimensional arm structure is somewhat analogous to the arms 352 of the embodiment of FIG. 20. However, these arms are completely encased within a petal frame 394. In the depicted embodiment, the tabs 400 face in opposing directions to enable mounting of rings or other components on opposite sides of the frame 390. The arms, however, can include tabs that face the same side of the frame 390, or can alternatively, include ornament mounting holes or other ornate structures according to this invention. By providing a pair of arms that are spaced at a least one end, an ornate and pleasing central arm structure with overall length, width and height can be formed. As in the other embodiments described herein, the arms 396 and 398 can be wider so long as their ends 402,404 and 406 are sufficiently narrow and long to allow the ends to be plastically deformed with an appropriate twist.

Figure 22:
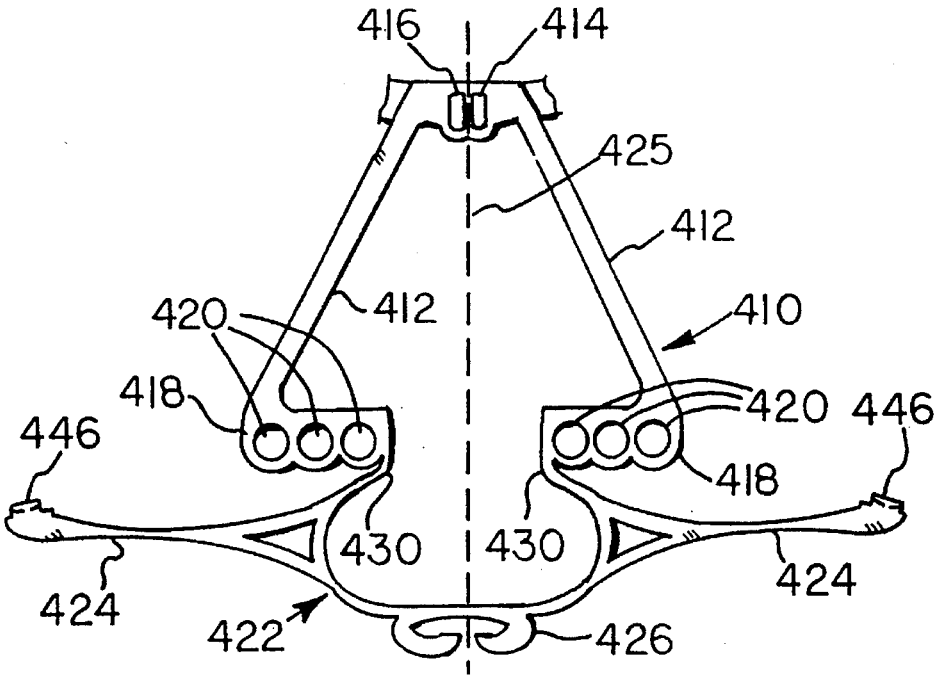
FIG. 22 is a plan view of a portion of a chandelier frame member for forming a two-tier frame structure according to this invention.
Figure 23:
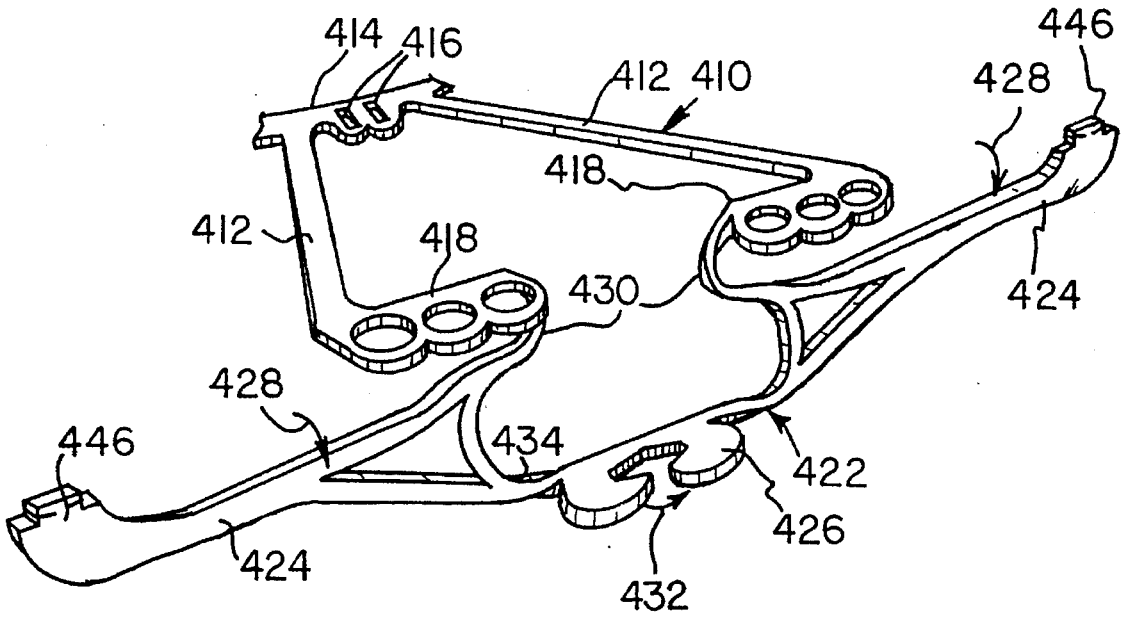
FIG. 23 is a perspective view of an initial step for forming a two-tier frame structure using the frame member of FIG. 22.
Figure 24:
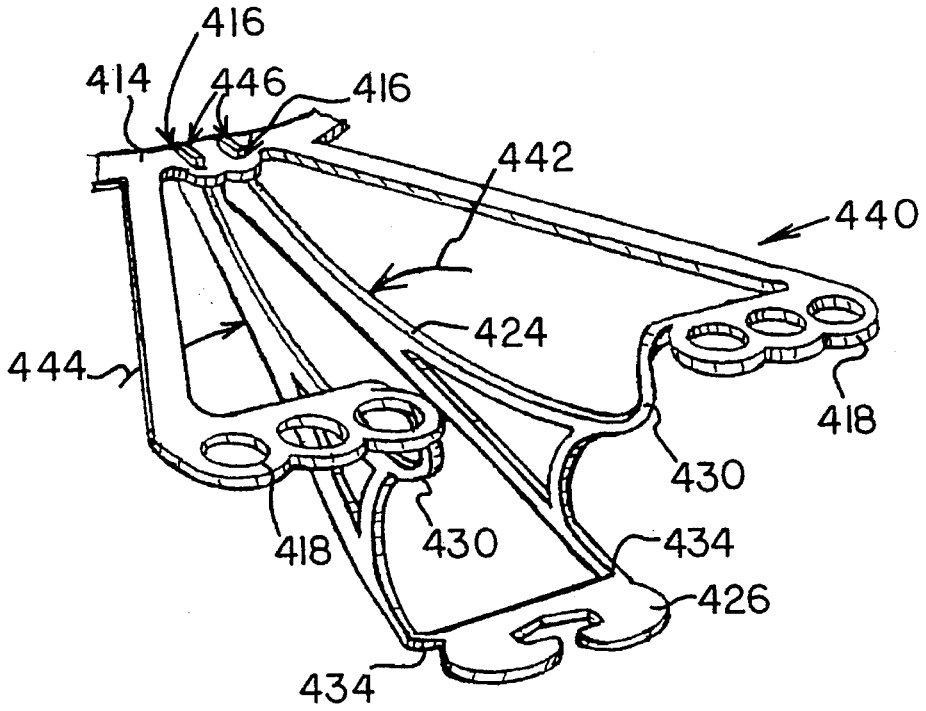
FIG. 24 is a completed two-tier frame structure of FIGS. 22 and 23.

The foregoing illustrated embodiments of FIGS. 20 and 21 detail one possible method for forming a structure that projects in three dimensions from an otherwise flat set of arms by plastically deforming the arms at predetermined locations thereon. FIGS. 22–24 detail a more complex structure according to this invention wherein a multi-tiered frame structure can be constructed from an otherwise, flat frame member 410 (FIG. 22).

The frame member 410, according to this embodiment, includes a pair of spokes 412 extending radially outwardly from a base portion 414, having a pair of slots 416 therein.

The spokes 412 are joined to a pair of rod support structures 418, defining holes 420, that can be used to support ornaments or glass rods according to this invention. Radially outwardly of the rod support structures 418 is positioned a multi-part structure 422 including a pair of support arms 424 that extend perpendicularly to a radius line 425. At a radially outermost position on the structure 422 is located a crystal drop support structure 426 for supporting an ornament chain as described further below.

To construct a two-tier frame from this otherwise, flat frame member 410, the support structure 422 is first bent downwardly as shown by the arrows 428. A bend is formed in the runners 430 that connect multi-part structure 422 and the rod supports 418. In this embodiment, the structure 422 is bent (arrow 428) so that it lies within a plane that is substantially perpendicular to a plane defined by the radial arms 412 of the member 410. To accomplish the bend of runners 430, the runners should be sized narrow enough to allow a rapid radius curve. As such, their width should be approximately equal to the thickness of the sheet stock from which the frame member 410 is formed.

As further illustrated in FIG. 23, the crystal drop support 426 is bent upwardly (arrow 432) so that it lies within a plane substantially parallel to that defined by the support arms 412. Runners 434, having an appropriately small width, are provided between the support arms 424 and the crystal support 426 to enable the formation of a rapidly twisted shape.

A frame section 440 is completed, as shown in FIG. 24, by rotating the support arms 424 rearwardly as shown by the arrows 442 and 444 so that tabs 446 located at the ends of the support arms 424 are aligned with the slots 416 of the base 414. The arms 424 can then be locked with the base 416 by twisting the respective heads of the tabs 446. According to this embodiment, the runners 430 and 434 receive multi-directional asymmetrical plastically deformed bends to generate a final frame shape. Accordingly, the runners should generally be longer than those required for a single unidirectional bend. In this embodiment, runners 430 and 434 having a length of approximately ¼ inch should suffice to provide a sufficient bend without undue stress concentrations that may weaken the frame. The resulting frame section 440 includes parallel tiers having a set of rod supports 418 on one level and a crystal drop support 426 on another axially remote level.

Figure 25:
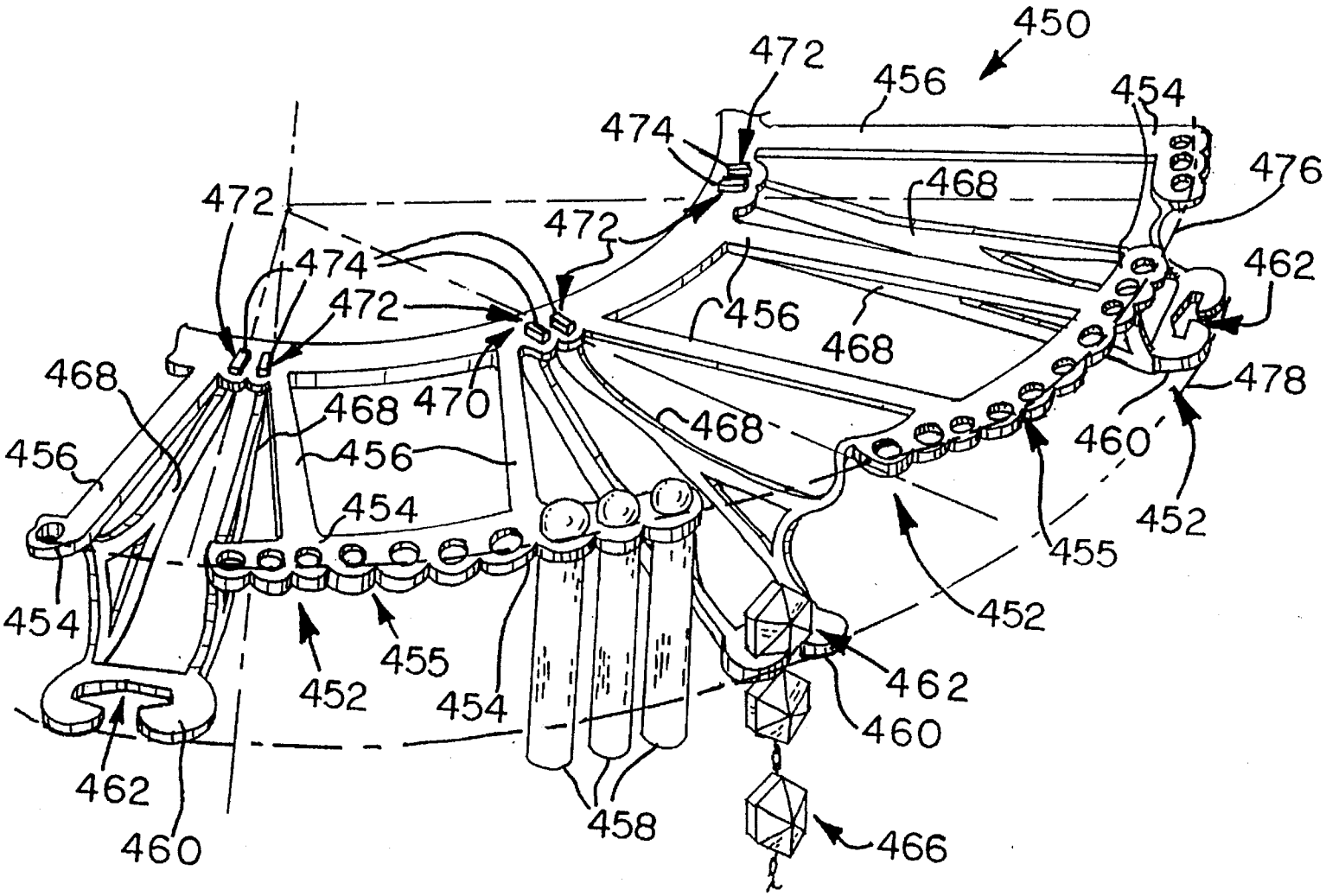
FIG. 25 is a partial perspective view of a chandelier frame constructed from two-tier frame members of FIGS. 22–24.

A practical application of this structure is illustrated in FIG. 25, in which a frame 450 is illustrated having a plurality of interconnected circumferentially positioned frame member sections 452. The frame member sections 452 are substantially similar to the sections 410 of the embodiment of FIGS. 22–24. The sections 452 each include pairs of circumferentially remote rod supports 454 that adjoin rod supports 454 of an adjacent section 452 via a connecting set of rod supports 455. the rod supports, 454 and 455 are positioned at the ends of arms 456. The rod supports 454 are used to carry glass rods 458 according to this embodiment. Between opposing sets of rod supports 454 are located, axially separated, crystal drop supports 460 with pockets 462 for holding crystal drops 464 according to this embodiment. The crystal drops, themselves, support ornament chains 466. The lower support arms 468 are bent rearwardly to join with a central ring 470 that is integral with the radially disposed arms 456 and lies on the same plane therewith. The ring 470 includes slots 472 for receiving tabs 474 located on the ends of the support arms 468. As a practical matter, construction of a ring having two-tier frame member sections 452, according to this embodiment, requires that the support arms 468 be laid out on a flat sheet so that they do not intersect one another. Otherwise, the support arms 468 could not be cut from a single sheet as part of an entirely integral frame member. Tn this embodiment, the connecting rod supports 455 provide the necessary spacing between sections 452 to prevent the support arms 468 from intersecting. The completed frame 450, hence, results in two discrete sets of hanging structures that are axially separated as illustrated by the semicircles 476 and 478.

Each of the foregoing embodiments has been constructed utilizing plastic deformation of at least some portion of an otherwise, flat frame member. As in the embodiments described in FIGS. 11–19, elastic deformation, in which spring tension is stored in the frame, has also been applied to flat frame members. It is also contemplated according to this invention that chandelier frames can be constructed from members that are essentially only elastically deformed.

Figure 26:
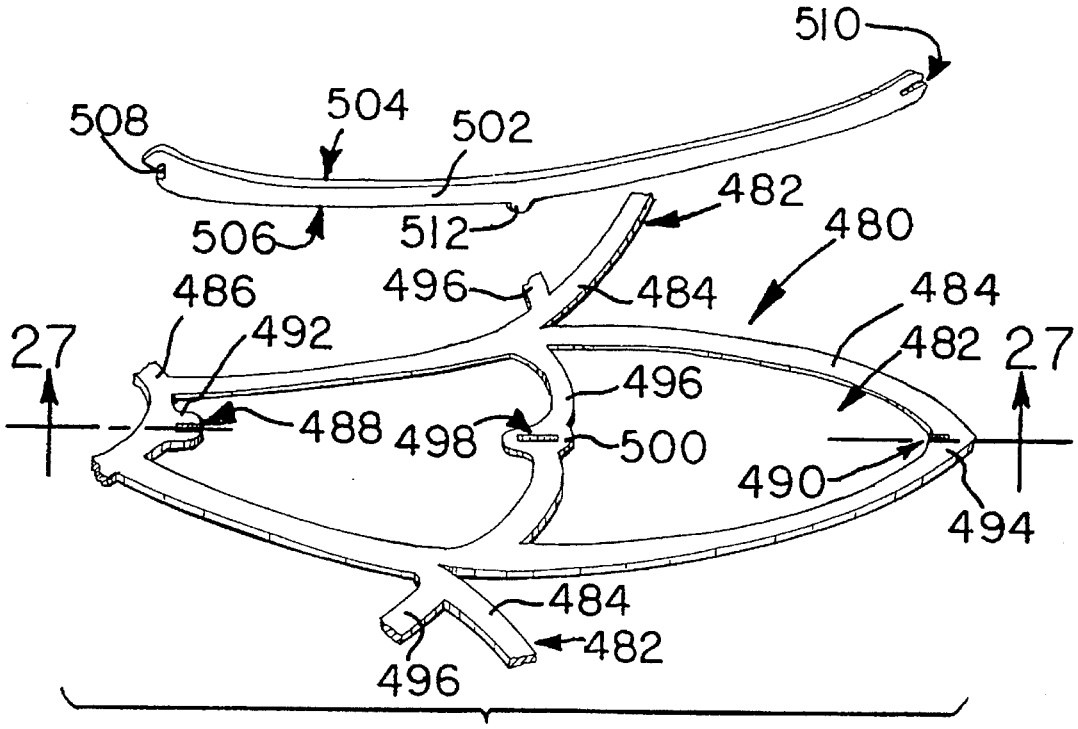
FIG. 26 is a partially exploded perspective view of a disassembled chandelier frame according to another embodiment.
Figure 27:
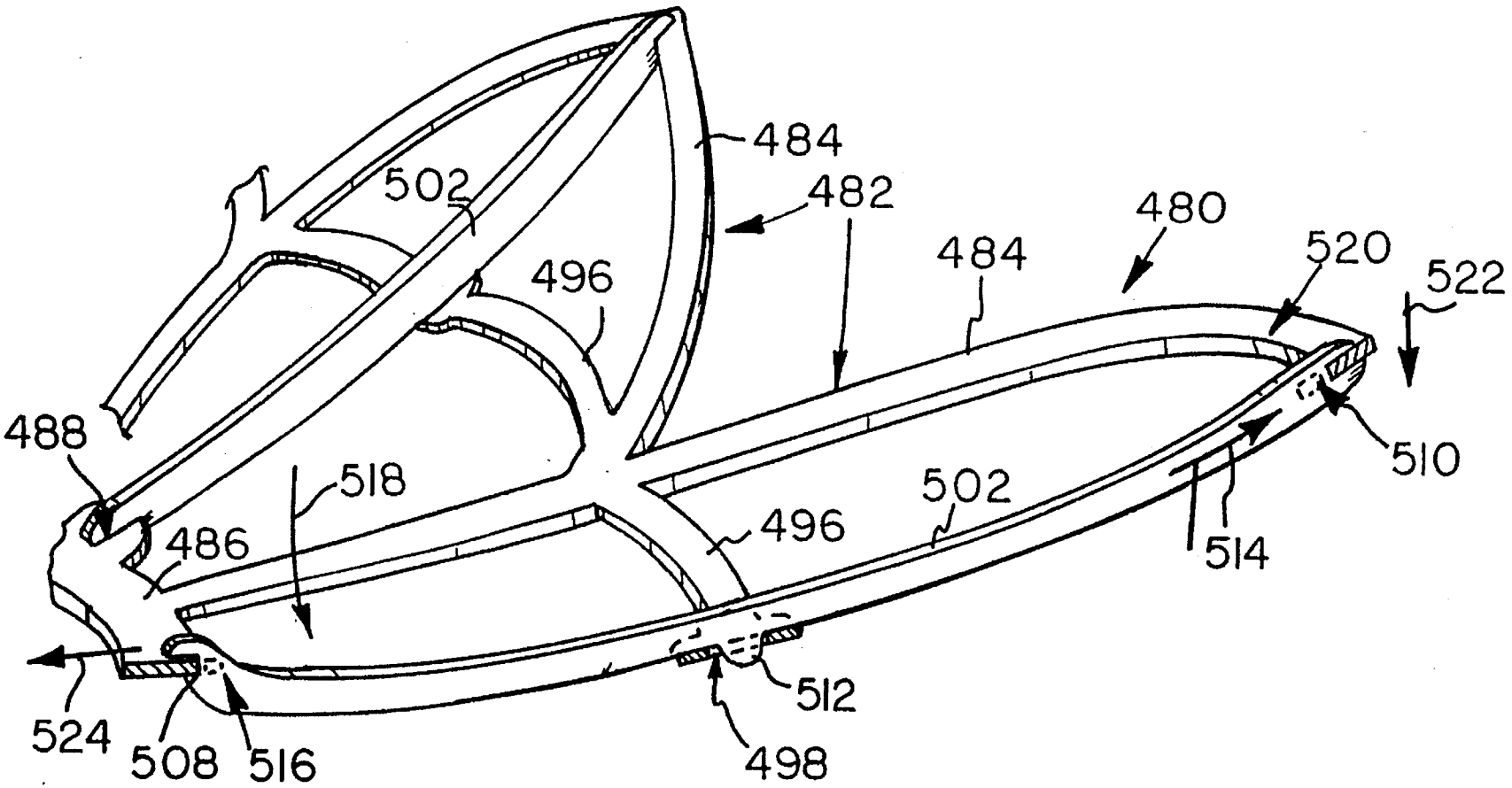
FIG. 27 is a partial perspective view of an assembled chandelier frame taken along line 27—27 of FIG. 26.

FIG. 26 depicts a portion of a frame member 480 having loops or petals 482 defined by interconnected petal frames 484. The petal frames intersect at a center ring 486 according to this embodiment. Each petal 482 includes a pair of slots 488 and 490 located at radially opposed points on the petal. The slot 488 is located on an extensive 492 of the center ring 486 and the radially outward slot 490 is formed into an inner facing side of the petal's outer point 494. The petal also includes a stylized centrally located cross-member 496 having a slot 498 at a center thereof on an enlarged slot structure 500. The frame member 480 can be constructed from flat sheet stock using a laser cutter or similar cutting device according to this invention. The slots 488, 490 and 498 of the chandelier frame are sized to engage opposing structures on a separate frame member 502. This frame member 502 is cut separately from sheet stock and includes a bowed shape defined by its widthwise edges 504 and 506. The frame member 502 is sized so that opposing slots 508 and 510 engage respective slots 488 and 490 on the petal 482 of frame member 480. A center nub 512 engages central slot 498. The location of slots 508 and 510 is such that the petal 482 must be curved upwardly to follow the contour of the widthwise edge 506 in order to receive slots 508 and 510 in respective slots 488 and 490. Accordingly, the frame member 502 acts as a spine as illustrated in FIG. 27 that holds the petal 482 in an upwardly curved shape. The nub 512 ensures that this spine 502 remains centered relative to the petal 482. The center support 486 is desirable since it provides an additional surface for the petal to bear against the spine 502, thus enhancing the curved shape of the frame member 480 and providing the desired bowl effect.

Assembly of a chandelier frame according to this embodiment entails the snap fitting of the spine 502 onto the petal 482 of the frame member 480. The grooves 490, 498 and 510 are sized to enable the spine to slide radially outwardly as shown by the arrow 514. The nub 512 should be sized so that it is movable radially in the slot 498. Accordingly, by sliding the arm in the direction of arrow 514 to engage slot 510 with frame member slot 490, and by simultaneously applying a downward force proximate a radially inward end 516 of the spine 502 (arrow 518), the slot 508 can be brought into engagement with the center ring slot 488. The downward force (arrow 518) causes the petal to elastically deform upwardly and, upon release of the pressure, while guiding slot 508 into slot 488, the structure becomes locked in an elastically deformed state. The radially outermost end 520 of the petal 482 provides a downward force (arrow 522) on the spine that is resolved into a radially inwardly directed component at the center ring 524. This force component maintains the spine slot 508 in engagement with the ring slot 488. Since the opposing spine slot 510 is long enough to remain in engagement with the petal frame 484 upon release of pressure (arrows 514 and 518), the frame remains interlocked in an elastically deformed state. In this example, the spring force is directly responsible for maintaining the spine 502 firmly interlocked with the petal 482. Absent such spring tension, the spine 502 would be only loosely attached to the frame member petal 482 and easily removed by application of only light pressure. Conversely, the assembled frame according to this embodiment becomes more tightly interengaged when weight is applied to the petals since the weight acts generally in the direction of arrow 522 and causes the spine 502 to impart a stronger component (arrow 524) on the center ring.

Figure 28:
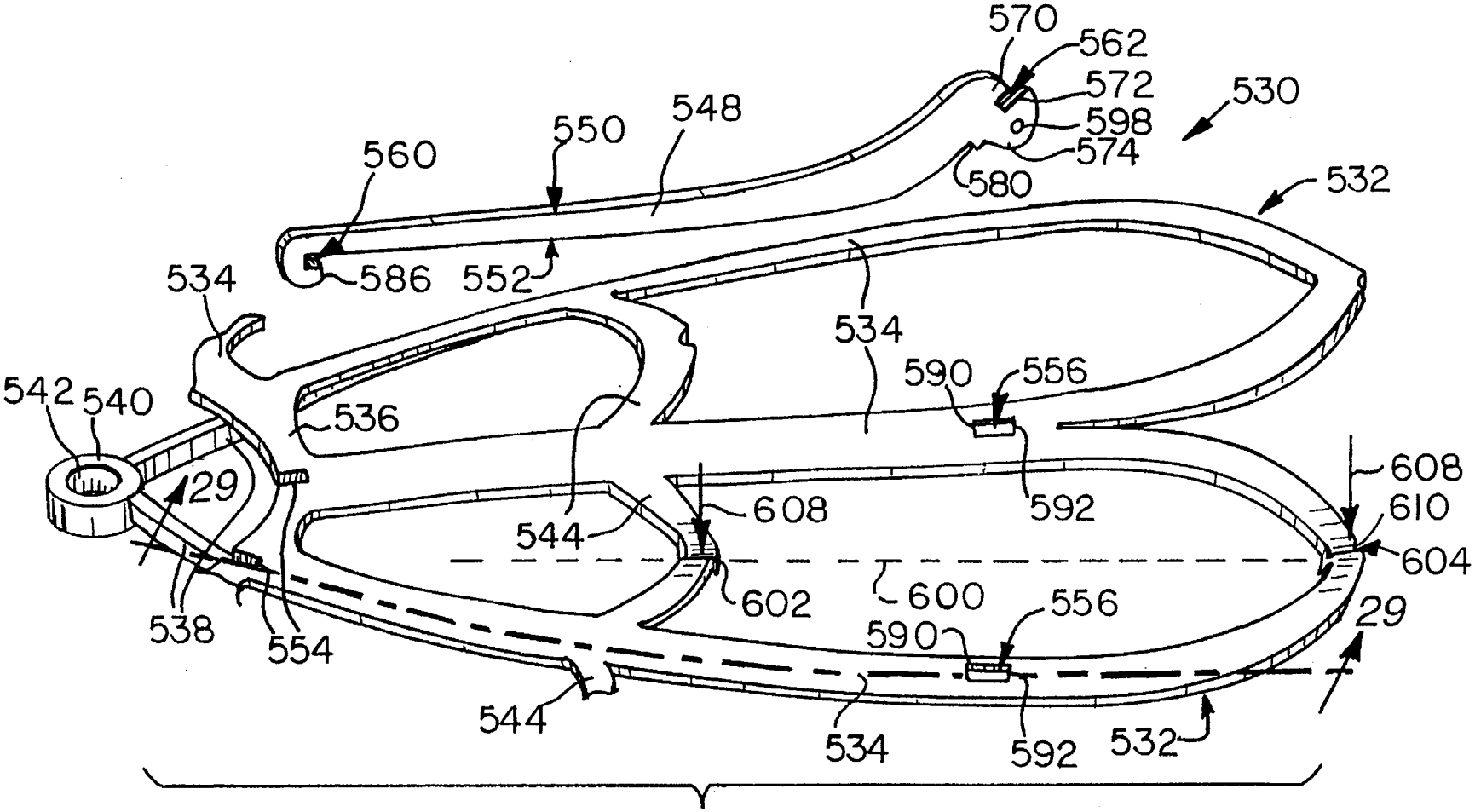
FIG. 28 is a partially exploded perspective view of an unassembled chandelier frame according to another embodiment.
Figure 29:
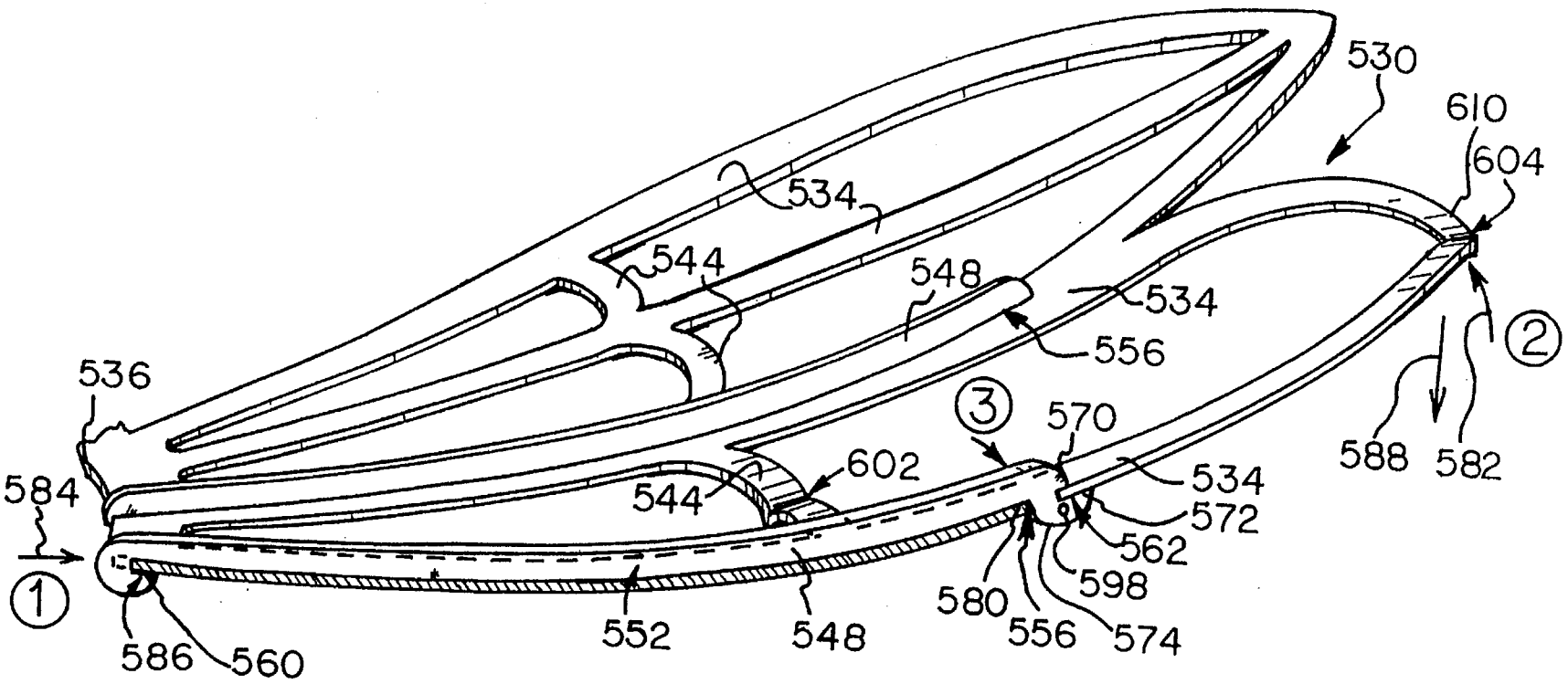
FIG. 29 is a partial perspective view of the assembled chandelier frame taken along lines 29—29 of FIG. 28.

A further embodiment in which spring tension assists in maintenance of the frame's final shape is illustrated in FIGS. 28–29. A portion 530 of a frame member is illustrated. The portion, in this embodiment, comprises a pair of petals 532 joined by a center post 534. Additional petals can be joined to the two depicted petals 532, but these petals have been omitted for clarity. The radial arms 534 extend outwardly from a center ring 536 according to this embodiment. The center ring can be attached to a set of spokes 538 interconnected with a post support 540 having a hole 542 for receiving a chandelier post. The petals include a connecting section 544 according to this embodiment. A spine frame member 548 having curved widthwise edges 550 and 552 is provided to interengage with a pair of slots 554 and 556 located on the arm 534 connecting petals 532. The slots 554 and 556 engage opposing slots 560 and 562 on the spine frame member 548.

Unlike the embodiment of FIGS. 26–27, this embodiment entails the use of a spine 548 that is disposed along a petal radial arm 534. Hence, the lower widthwise edge 552 of the frame member 548 contacts the frame 530 along essentially its entire length. This ensures that a curve that closely conforms to the outline of the lower widthwise edge 552 is generated in the lower frame member 530. The assembled frame structure is illustrated in FIG. 29. The spine, includes a slot 562 that is defined between an upper wall 570 and a lower wall 572. The lower wall is somewhat longer than the upper wall and forms part of a curved structure 574 that protrudes below the level of the lower widthwise edge 552. According to this embodiment, the structure is placed through the radially outermost slot 556 on radial arm 534. To insert the structure 574 into the slot 556, the spine is aligned approximately perpendicularly to a plane defined by the frame member 530. As the structure is passed through the slot, the spine 548 is then rotated so that the lower wall 562 is rotated into contact with the lower face of the frame member 530. The slot 556 is sized to enable slight radial dislocation of the structure 574 within the slot. To this end, a rear shoulder 580 on the structure 574 is spaced at a distance from a radially inward wall of the slot 556 when the spine 548 is in a radially outwardmost position in the slot.

Accordingly, final assembly of the frame using spines 548 entails the rotation of the spines so that its lower widthwise edge 552 engages the radial arm 534 of the frame member 530. With the frame bowed upwardly as shown by arrow 582, the spine is pushed radially outwardly (arrow 584) until the rear spine slot 560 engages the radial arm slot 554. When the lower surface 586 of the rear spine slot 560 comes into engagement with a bottom face of the radial arm 534, the spine is then firmly interengaged with the frame. The spring tension of the frame which acts downwardly as shown by arrow 588 causes the radially inward wall 590 of slot 556 (FIG. 28) to engage the rear shoulder 580 of the spine 548.

Figure 30:
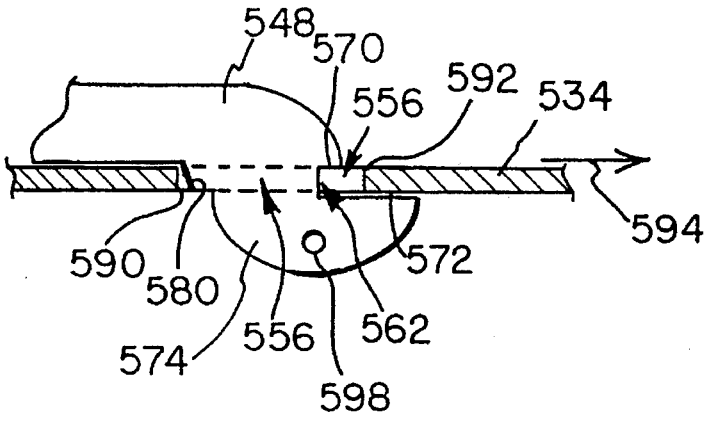
FIG. 30 is a detailed cross-section of the region of interengagement between frame member slots of FIG. 29.

Hence, spring tension naturally drives the spine radially outwardly as shown by arrow 548 to maintain the rear spine slot 560 in firm engagement with the radial arm slot 554. The lower surface 572 of the structure 574 is long enough that it continues to engage a lower face of the radial arm 534 even when the radially inward wall 590 of the slot 556 bears against the structure wall 580, leaving a gap at the radially outward portion of the slot. This relationship is illustrated in FIG. 30 in which the radially outwardmost wall 592 is clear of the upper spine slot wall 570, but the lower structure wall 572 is still in engagement with a bottom face of the arm 534. Note that the rear wall of the slot 590 abuts the rear wall 580 of the structure 574. The spring tension in the frame generates a force (arrow 594) that maintains slot wall 590 in engagement with structure wall 580. Accordingly, the entire spine is pulled radially outwardly until spine rear slot 560 engages a radially outermost wall of arm slot 554.

As noted above, holes for mounting chandelier ornaments can be provided at various points on the frame members according to this invention. Such holes can be formed at the time that the frame members are cut, thus enhancing the accuracy of the final placement of ornaments. In this embodiment, an exemplary hole 598 is located on the structure 574 of the spine 548. Additionally, while a non-planar chandelier frame can be constructed solely from elastically deformed frame members according to this embodiment, it is contemplated that plastic deformation can be applied to the frame members to enhance the appearance of the finished frame. In this embodiment, the petals 532 are plastically deformed along their axis of symmetry 600 to form a downwardly directed V-shape 602 and 604 as illustrated by the arrow 606 and 608, respectively. The V-shape 602 and 604 located at the center section 544 and petal end 610 provides a pleasing contour to the frame's final bowl shape.

Figure 31:
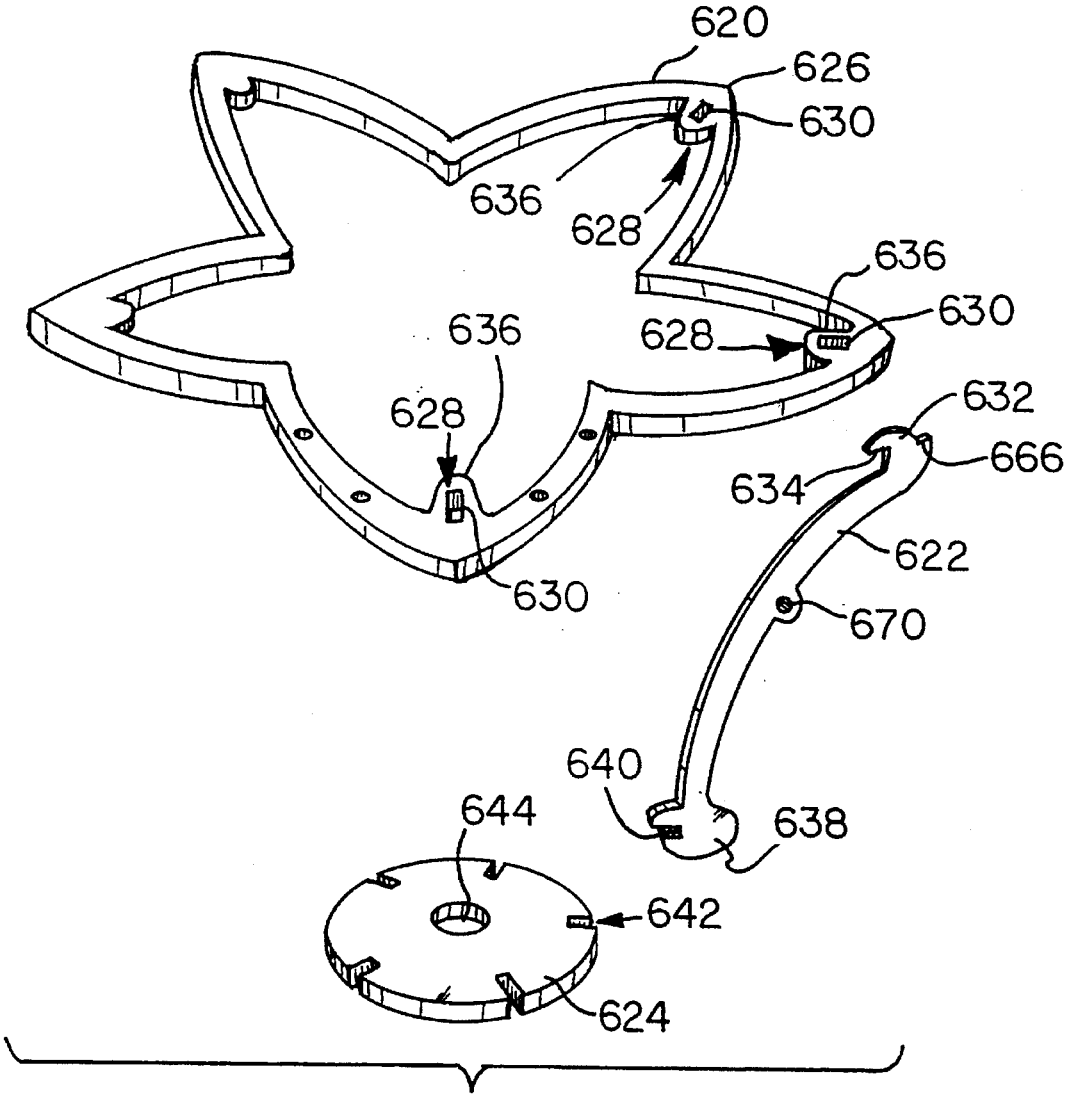
FIG. 31 is an exploded perspective view of a crown piece for a chandelier frame according to this invention.

The concepts discussed herein need not be applied only to a main bowl structure of a chandelier frame. Rather, any portion of a chandelier frame that extends in three dimensions can utilize the elastic and plastic deformation concepts taught herein. FIG. 31 illustrates a group of unassembled frame members formed from sheet stock utilizing a laser cutter or like apparatus. These frame members, which include a star or flower-like ring 620, an arm 622 and a base 624, are assembled to form a crown piece of a chandelier that can be located typically at the top or bottom of the overall framework.

The ring 620 includes a plurality of points 626 each having a slot-bearing structure 628 according to this embodiment. The slots 630 on each slot-bearing structure 628 are sized to engage hook-like structures 632 on an upper end of the arms 622. Each hook-like structure includes an upper surface 634 sized to bear against a radially inward portion 636 of an upper face of the ring 620. The arm extends downwardly and radially inwardly from the upper hook-like structure 632. The arm terminates in a lower slot-bearing structure 638 having a slot 640 facing radially inwardly. The slot 640 is sized to engage an opposing slot 642 on the base. Note that the base according to this embodiment includes a center hole 644 for mounting the base on a chandelier post.

Figure 32:
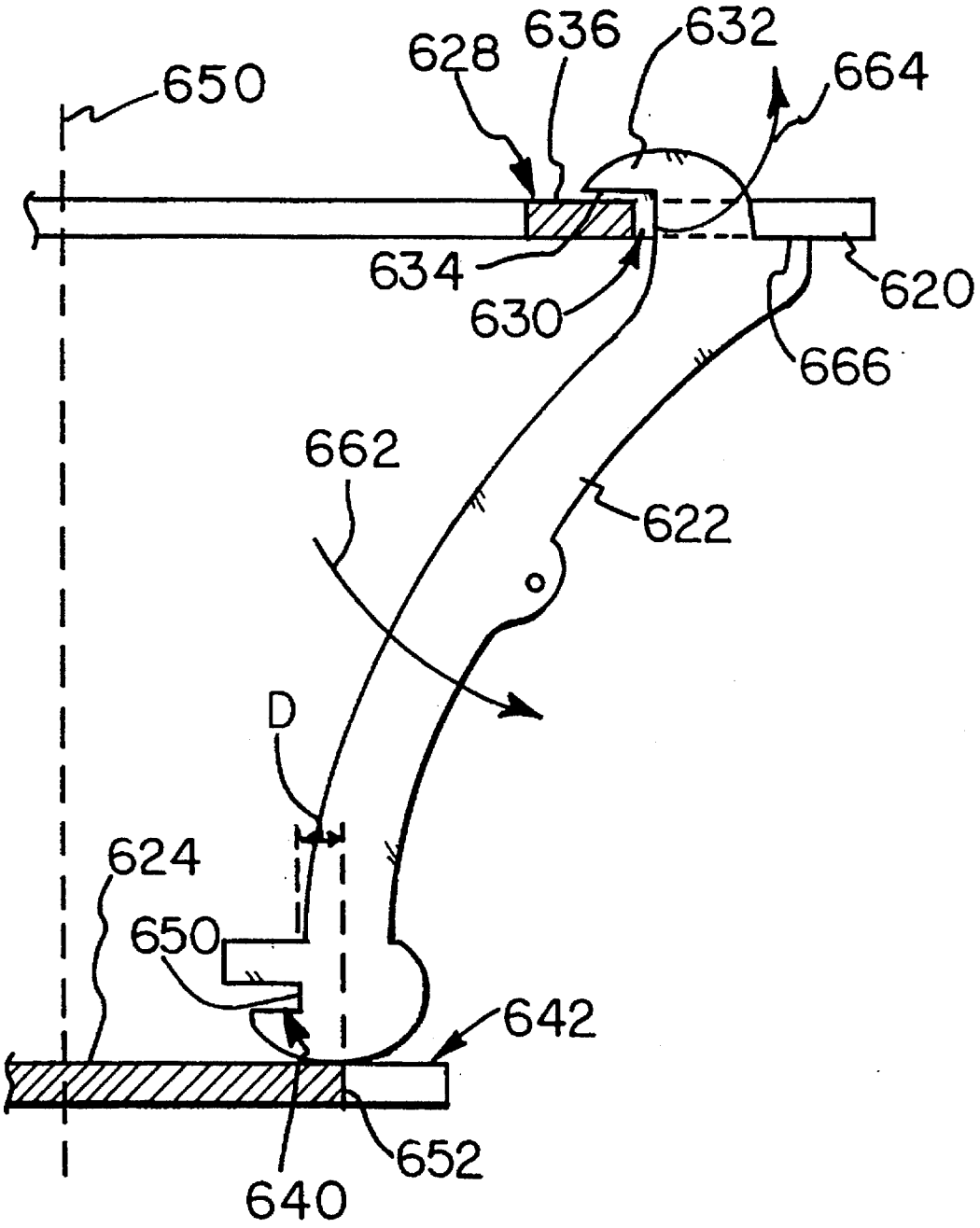
FIG. 32 is a cross section of the crown piece of FIG. 31 illustrating the relative positioning of frame members.
Figure 33:
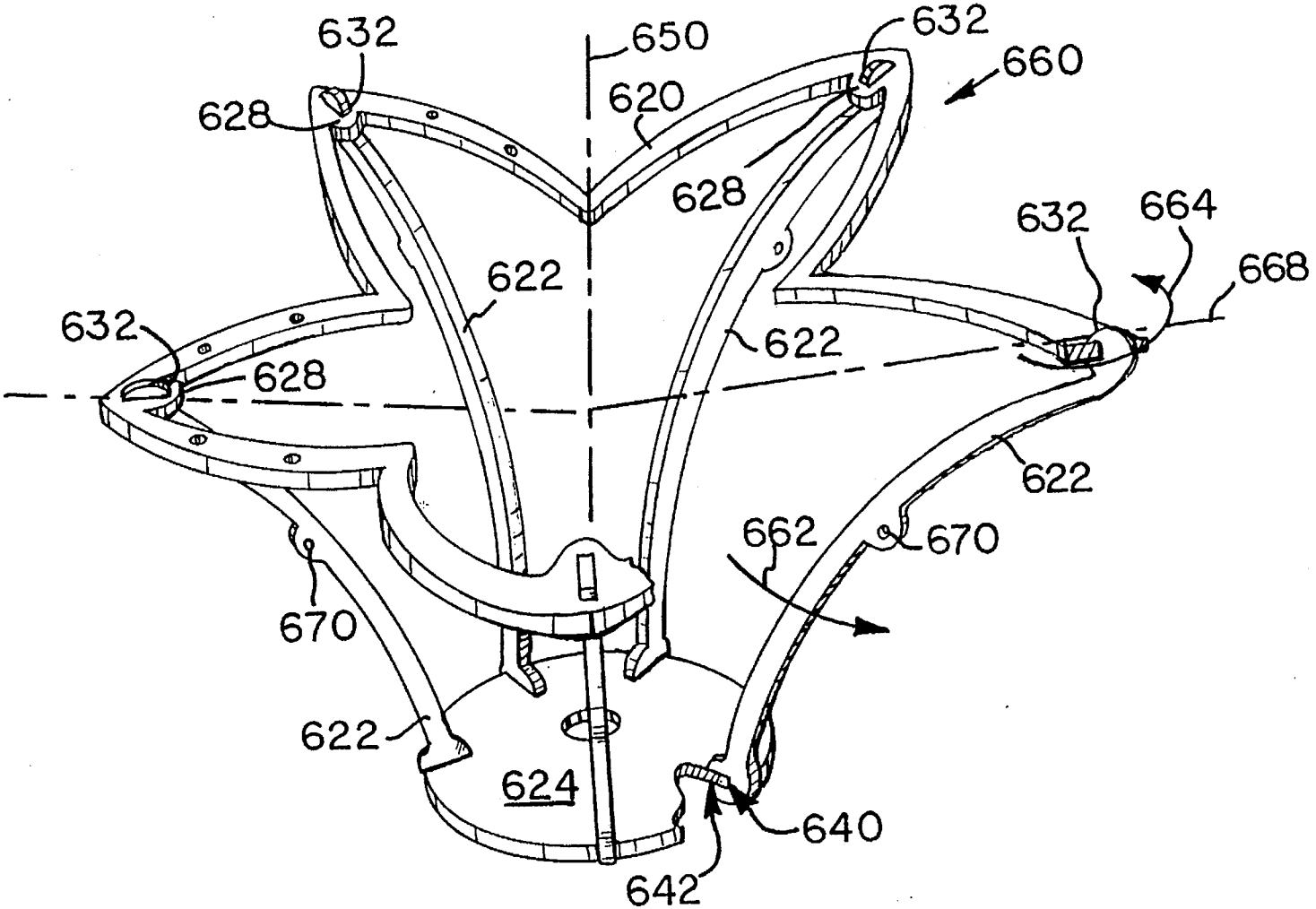
FIG. 33 is a partially broken perspective view of the assembled crown piece of FIG. 31.

As detailed in FIG. 33, the arms maintain the ring 620 and the base 624 in axial relationship to each other. The arms are sized so that when the hook-like structure 632 are passed through the slots 630 of the ring, and the upper wall 634 lie flat against radially inward surface 636 of an upper face of the hook-bearing structure 628, the lower slot-bearing structure 638 are positioned substantially radially inwardly relative to the base slots 642. This relationship is further detailed in FIG. 32. Assuming that the upper ring 620, which is flat in this illustration, is concentric with the base ring 624, about a center axis 650, the end 650 of slot 640 is separated by a distance D from the end 652 of slot 642. Accordingly, slot 640 is radially inward by a distance D relative to base slot 642. As a result, the arm slot 640 cannot be interengaged with the base slot 642 without deforming at least one of the arm 622 or the ring 620. This misalignment provides the spring force needed to maintain the completed frame 660 (FIG. 33) intact.

To interengage the arm slot 640 with the base slots 642, the arms must be rotated radially outwardly as shown by arrow 662. This rotations generates a moment about the ring 620 as indicated by arrow 664. This is because, once the hook-like structure 632 is engaged in slot 630, the hooks upper surface 634 and radially outwardly directed lower surface 666 bear against opposing faces of the slot bearing structure 628. The moment 664, when applied at each of the slot-bearing structure 628 about the perimeter of the ring 620, causes the ring to slant inwardly as indicated by the contour line 668 (FIG. 33). The resulting effect is a bowled-in crown. The distance D should be chosen so that the bowled-in crown is not steep enough to cause the material to exceed its elastic limit. Substantially all energy generated by the moment 664 is stored a spring energy. The crown, thus, biases each of the arms radially inwardly in a direction opposite arrow 662. By locating each of the lower arm slot 640 into a respective base slot 642, the arms are prevented from rotating radially inwardly back to a position in which the ring is unstressed. Hence, the arms remains biased radially inwardly, firmly engaged with the slots 642 and the bowled-in crown shape is maintained in the ring.

Assembly of such a crown shape is relatively simple. The hook-like structures of the arms are guided through respective slots 630 and the ring and each arm 622 is then rotated as shown by arrow 662 and subsequently returned into engagement with a respective base slot 642, the process of rotating and returning continues until all arms 622 are located in a base slot 642. The resulting structure can often be strong enough to require no further restraining members proximate the base ring. It should be noted that the frame 660 ring is held together only by the tension force of the upper ring 620 which can be overcome by applying appropriate force to the arms 622 in a direction opposite arrows 662. Application of weight via, for example, ornaments only serves to increase the moment 664 about the hook-like structures thus increasing the radially inwardly directed force on the arms. To this end, structures bearing holes 670 for mounting hooks can be provided to the arms or crown ring 620.

Figure 34:
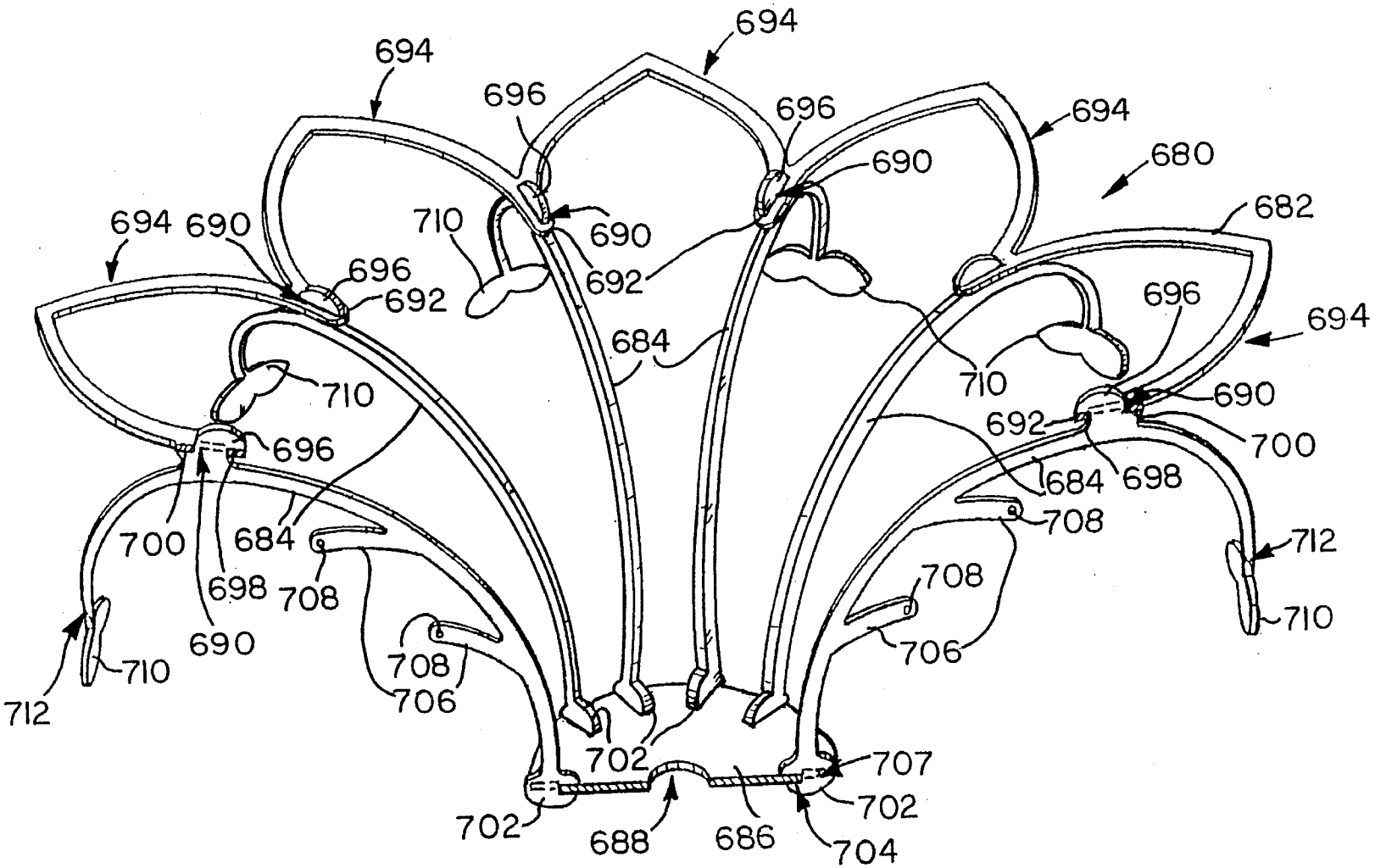
FIG. 34 is a partial perspective view of an another embodiment of a crown piece according to this invention.

The embodiment of FIGS. 31–33 details a frame member structure in which only elastic deformation is used form and maintain a complex three-dimensional shape. FIG. 34 illustrates a more ornate embodiment utilizing the concepts of FIGS. 31–33.

The frame 680 of FIG. 34 comprises a multi-petal ring 682 attached by arms 684 to a circular base 686 having a mounting hole 688 at a center thereof. The ring 682, arm 684 and base 686 are constructed and assembled in the manner similar to that described for the embodiment of FIGS. 31–33. In this embodiment, however, the attachment slots 690 of the ring 682 are located at radially inwardly directed junctions 692 that connect petals 694 together. The arms 684 interengage with the slots 690 by means of hook-like structures 696 substantially similar to those described for the embodiment of FIGS. 31–33. The hook-like structures 696 include an upper surface and a lower surface 698 and 700, respectively, that bear against opposing bases of the ring 682, adjacent respective slots 690.

Similarly, the arms 684 include a lowermost slot-bearing structure 702 having a slot 704 that engages an opposing slot 706 on the base 686. As in the above-described embodiment of FIGS. 31–33, the arms 684 are shaped so that, when engaging a flat ring 682, the arm slots 704 are located radially inwardly relative to the base slots 706. Accordingly, moving the arms radially outwardly to engage the base 686 causes the ring 682 to deform elastically and to store spring energy that maintains the slot bearing structures 702 of the arms 684 biased radially inwardly into the base slots 706.

The frame 680, and any of the other chandelier frames described herein, can be finished by appropriate plating, painting, vapor deposition, or similar finishing techniques. The arms 684, according to this embodiment, include secondary arms 706 that enable hanging of additional ornaments through mounting holes 708. The arms 684 according to this embodiment further include plastically deformed end ornaments 710 that extend radially outwardly from the hook-like structure 696. The leaf-like ornaments 710 are formed as part of the arm on a flat sheet and are subsequently twisted (twist 712) so that they are aligned in a plane perpendicular to a plane defined by the rest of the arm 684. Hence, the frame 680 according to this embodiment incorporates elastic deformation in its upper ring 682 and plastic deformation in the arm ornaments 710 in order to generate a pleasing and interesting structure that is highly simulative of a more conventional chandelier constructed by welding or soldering discrete pieces together.

Unlike a conventional chandelier, however, the depicted embodiment is substantially more accurately fitted and can be constructed more rapidly by less skilled personnel. The overall design of the chandelier can be accomplished using a computer-aided design program, which can be routed directly to a laser cutter that generates the appropriate components. These components, due to the use of a computer-controlled cutter, are highly accurate, thus enhancing the overall optical appearance of the finished chandelier.

Figure 35:
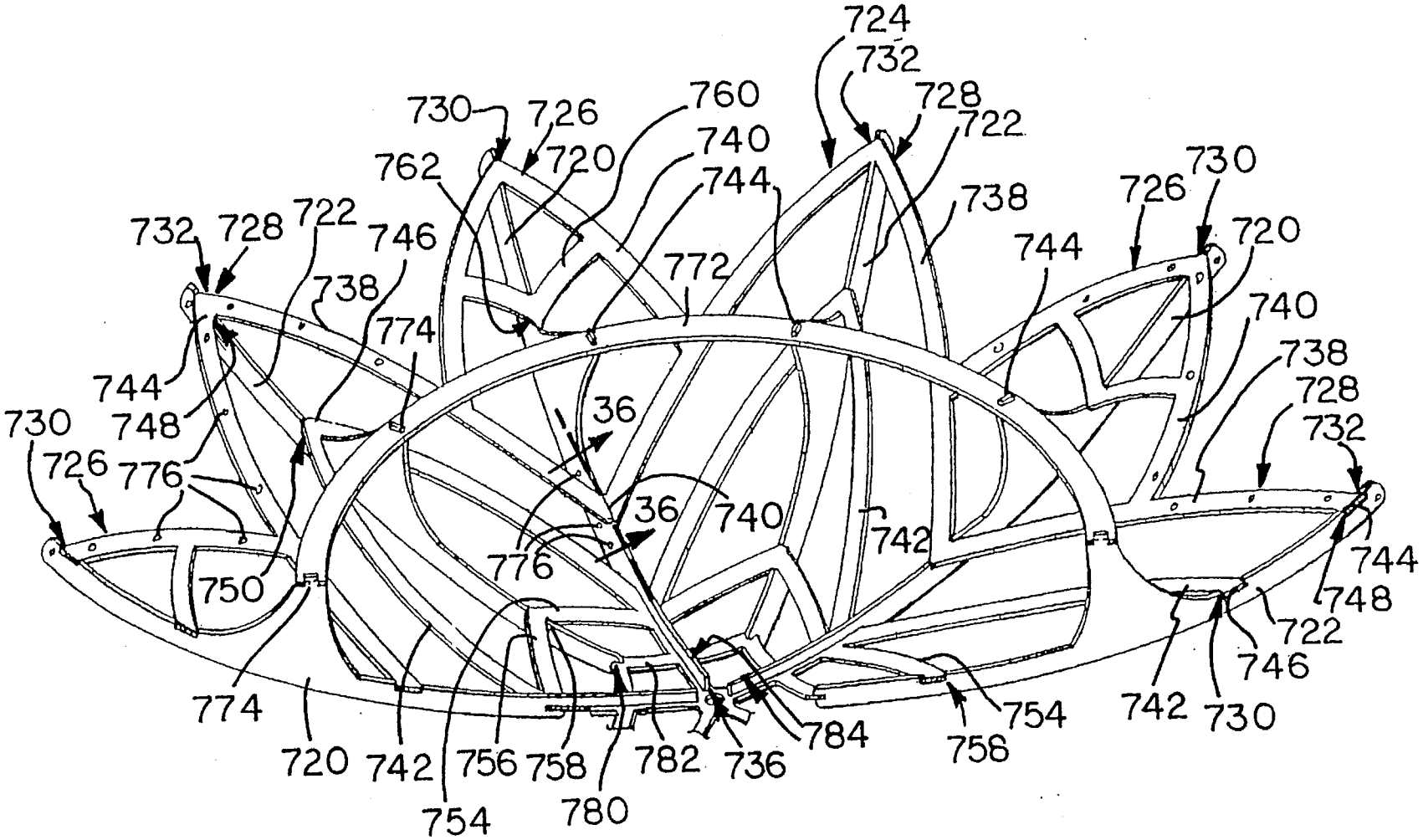
FIG. 35 is a partial perspective view of a chandelier frame according to another embodiment.

FIG. 35 illustrates a final embodiment, according to this invention, in which a plurality of arms or spines 720 and 722 are used to support a multi-petal frame member 724 according to this embodiment. The petals 726 and 728 extend radially outwardly to points 730 and 732, respectively. The petals 728 alternate with adjacent petals 726 circumferentially about the chandelier's center 736. Each of the petals 728 defines an outer petal frame 738 that interconnects with the outer petal frame 740 of adjacent petal 726. Each petal frame 738 interconnects with another similar petal frame at a radially inwardly disposed junction 740. An internal petal frame 742 is disposed radially inwardly of the outer petal frame 738. Each of the petal frame 738 and 742 includes radially outwardly disposed points 744 and 746, respectively, that are seated in channels 748 and 750 on arms 722. A further more radially inwardly disposed petal frame 754 is also enclosed by the more outwardly disposed petal frames 742 and 738. This frame also includes a joint 756 aligned within a channel 758 according to this embodiment. Similarly, the petal frames 740 include an inwardly directed V-shaped member 760 located between the junction 740 of petal frames 738 and the point 730 of petal 726. This V-shaped member 760 is located in a corresponding channel 762 on arm 720.

Accordingly, a multiplicity of frame members are secured in the arms 720 and 722 at predetermined points therealong.

Figure 36:
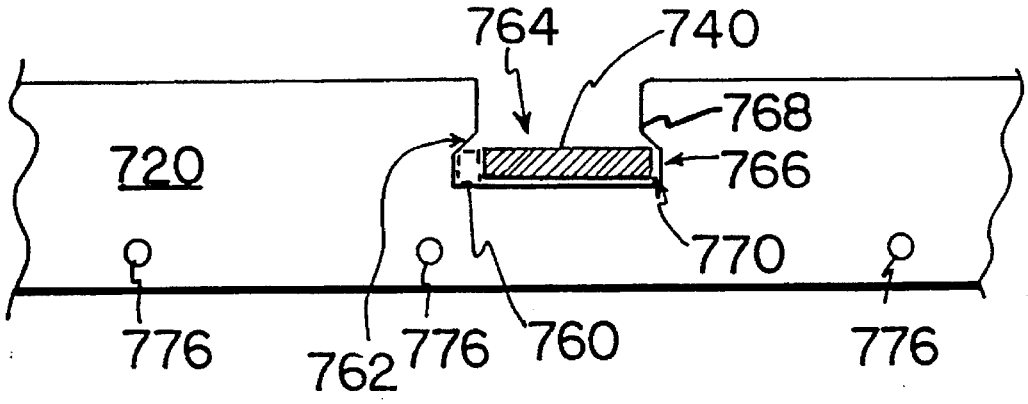
FIG. 36 is a more detailed cross-section of a frame member interconnection taken along line 35—35 of FIG. 33.

These members are secured using a snap-fit channel structure that is illustrated in more detail in FIG. 36. FIG. 36 illustrates the interconnection between junction 740 of petal frame 738 and frame member 720. The junction point 740 includes a notch 760 that surrounds the radially inward wall 762 of the pocket 764. The opposing wall 766 of the pocket 764 includes a shoulder 768 that is directed radially inwardly slightly further than a radially outwardmost thickness edge 770 of junction 740. The shoulder 768 maintains the junction point 740 in firm engagement with the pocket 764 once the junction is snapped over the shoulder 768 into the pocket 764. Accordingly, the frame member 724 can be assembled to the arms 720 and 722 by snapping various sections of the member into corresponding pockets. Since the pockets maintain the frame member sections in interengagement with the arms, against radial movement along the arms, the plastically deformed bowl-like shape of the frame member is maintained. The frame, according to this embodiment, further includes a locking ring 772 that is joined by tabs 774 to the arms 720 and 722. The locking ring enhances the rigidity of the frame. Since it is located along the top of the frame, it is not generally visible when the frame is in a hanging position with ornaments attached thereto from holes 776 provided for ornament hooks.

The frame member 724 according to this embodiment includes a mounting hole 736 at its center. Arms 720 extend substantially to the mounting hole, while alternating arms 722 are joined via slots 780 to an innermost ring 782 radially remote from the mounting hole. The arms 720 and 722 can be secured axially by providing an enlarged plate over the top edges 784 of the arms that is locked by an appropriate bolt located through the hole 736.

The foregoing has been a detailed description of preferred embodiments. Various modifications and additions can be made without departing from the spirit and scope of this invention. For example, a variety of materials that can be elastically and/or plastically deformed can be utilized according to this invention, including certain plastics, metals, composites, and fibrous compounds. Similarly, the concepts disclosed herein are applicable to a variety of different chandelier structures and designs. Structures constructed according to this invention can be utilized in combination with more conventionally constructed components, or can be used to construct virtually an entire chandelier frame. Accordingly, this description is meant to be taken only by way of example and not to otherwise limit the scope of the invention.

What is claimed is:

1. A chandelier frame comprising:

a first frame member;

a second frame member remote from the first frame member; and a plurality of arms connecting the first and second frame members, wherein the first frame member is connected to each arm at a respective first joint that is plastically and asymmetrically deformed and that is free of breaks, and wherein the second frame member is connected to each arm at a respective second joint that is free of breaks.

2. A chandelier frame as set fourth in claim 1 wherein the joints between the second frame member in the arms are plastically and asymmetrically deformed.

3. A chandelier frame as set forth in claim 1 wherein the first frame member lies substantially in a first plane and the second frame member lies substantially in a second plane.

4. A chandelier frame as set forth in claim 1 wherein the first frame member lies in a plane in an unstressed position and is locked to the second frame member in a non-planar, elastically stressed position.

5. A chandelier frame as set forth in claim 4 wherein the first frame member and the second frame member are locked in said stressed position by a tab and slot arrangement.

6. A chandelier frame as set forth in claim 2 wherein the first and second joints comprise twisted joints.

7. A chandelier frame as set forth in claim 1 wherein the frame members comprise rings.

8. A chandelier frame as set forth in claim 1 wherein the arms define planes and have been positioned in their respective planes by rotating the arms to create the plastically and asymmetrically defined joints.

9. A chandelier frame constructed by a process comprising:

cutting a first frame member, a second frame member and a plurality of arms, the arms having first and second joints that are aligned non-radially, from a substantially flat sheet lying in a first plane;

applying a separation force between the first frame member and the second frame member in a direction substantially perpendicular to the first plane; and causing substantially simultaneously a rotation between the first frame member and the second frame member to place the arms into a predetermined alignment and to locate the second frame member in a second plane remote from the first plane.

10. A chandelier frame constructed by a process comprising:

cutting a first frame member, a second frame member and a plurality of arms from a sheet that lies substantially in a first plane, the arms connecting the first frame member to the second frame member; and twisting the arms to rotate each of the arms into a respective plane aligned substantially transverse to the first plane.

11. A chandelier frame as set forth in claim 10, formed by the further step of elastically deforming the first frame member so that it is oriented substantially out of the first plane and attaching a third frame member to maintain the first frame member in the elastically deformed state.

12. A chandelier frame as set forth in claim 10 wherein the step of cutting includes forming the arms so that each of the arms is radially aligned subsequent to the step of twisting.

13. A chandelier frame comprising:

a first frame member; and an arm member connected to the first frame member, the arm member carrying a locking structure, wherein the arm member is twisted into a plane substantially transverse to a plane defined by the first frame member in an unstressed state, thereby positioning the locking structure at a point remote from the plane defined by the first frame member.

14. A chandelier frame as set forth in claim 13 further comprising a second frame member locked to the locking structure.

15. A chandelier frame as set forth in claim 14 wherein the second frame member holds the first frame member in a non-planar, elastically stressed position.

16. A chandelier frame as set forth in claim 13 wherein the first frame member is connected to the arm member at a joint that is plastically and asymmetrically deformed.

17. A chandelier frame as set forth in claim 13 wherein the first frame member also carries a locking structure, and wherein the arm member is twisted so that the locking structure of the first frame member and locking structure of the arm member are interengaged.

18. A chandelier frame as set forth in claim 17 wherein the locking structures comprise tabs and slots.

19. A chandelier frame as set forth in claim 14 further comprising narrowed joints at which the arm member is twisted.

20. A chandelier frame comprising:

a first ring that is in an unstressed state substantially flat and defines a plane; and a locking frame member including a locking structure for interengaging the first ring, wherein the locking structure is locked to the first ring in a predetermined relationship to hold the ring in a non-flat, stressed, elastically deformed state.

21. A chandelier frame as set forth in claim 20 wherein the locking frame member is free of breaks.

22. A chandelier frame as set forth in claim 20 wherein the locking structure of the locking frame member interengages a locking structure of arms connected to said first ring to hold the first ring in the elastically deformed state.

23. A chandelier frame as set forth in claim 20 further comprising arms extending from the locking structure of the locking frame member and interengaging the first ring to hold the first ring in the elastically deformed state.

24. A chandelier frame as set forth in claim 23 wherein the arms are interengaged with the locking structure of the locking frame member and with the first ring by mating grooves.

25. A chandelier frame asset forth in claim 20 wherein the locking frame member comprises an arm and further comprising a base, the base being spaced axially remote from the ring.

26. A chandelier frame as set forth in claim 25 wherein each of the base and the arm includes interengaging formations for securing the base and the arm together, the interengaging formations being located on the arms so that, when the arm and the base are secured together, the ring is held in the non-flat, stressed, elastically deformed state.

27. A chandelier frame as set forth in claim 26 further comprising a plurality of arms, each of the arms including interengaging formations for securing the base and the arms together, the interengaging formations being located on the arms so that, when the arms and the base are secured together, the ring is held in the non-flat, stressed, elastically deformed state.

28. A chandelier frame as set forth in claim 27 wherein each of the base and the ring define a center axis, the base and the ring being axially remote thereon, the arms being disposed at circumferentially separated locations about the axis.

29. A chandelier frame as set forth in claim 20 wherein the locking frame member comprises an arm constructed and arranged to interengage with a pair of remote locations on the ring.

30. A chandelier frame as set forth in claim 29 wherein the arm is flat and is oriented in a plane that is substantially perpendicular to a plane defined by the first ring when the first ring is in an unstressed state, the arm including a widthwise edge having a curved contour, the first ring being elastically deformed to engage the curved contour when the arm is interengaged with the first ring at each of the two locations.

31. A chandelier frame as set forth in claim 29 wherein the locking structure comprises a plurality of arms that each interengage the ring at a pair of remote locations, the arms being substantially radially aligned about a center axis and being spaced about a circumference of the first ring taken relative to the center axis.

32. A chandelier frame as set forth in claim 20 further comprising a second ring that is substantially flat and that lies within the plane of the first ring in an unstressed state and further comprising a plurality of arms interconnected between the first ring and the second ring, the arms lying in the plane in an unstressed state, and the arms each being plastically deformed to define other planes substantially transverse to the plane of the first and the second ring, the locking frame member interengaging the arms at predetermined locations thereon to hold the first ring in the non-flat, stressed, elastically deformed state.

33. A chandelier frame as set forth in claim 32 wherein the plurality of arms located between the first ring and the second ring are positioned at circumferentially spaced points about the first ring and about the second ring, the arms being substantially radially aligned relative to an axis of the rings when the arms are in the plastically deformed state.

34. A chandelier frame as set forth in claim 33 wherein the locking frame member comprises a locking ring having a plurality of locking structures for engaging at least some of the plurality of arms at the predetermined locations thereon.

35. A chandelier frame as set forth in claim 34 wherein the locking structures of the locking ring are located at radially offset locations from corresponding interengaging locking structures at the predetermined locations on the arms when the first ring is in an unstressed state, whereby the arms are moved radially to align the locking structures of the arms with the locking structures of the locking ring.

36. A chandelier frame as set forth in claim 32 wherein the arms comprise a plurality of interconnected legs.

37. A chandelier frame as set forth in claim 32 wherein the arms include narrow runners proximate each of the first ring and the second ring, the runners constructed and arranged to enable a plastically deformed twist to be formed thereover.

38. A work piece for a chandelier frame comprising:

a first ring;

a second ring concentric with and lying within the first ring, said second ring and first ring being flat and lying substantially within a plane; and a plurality of arms connecting the rings at non-pivoting joints, the joints between each arm and the first ring being non-radially aligned with respect to the joints between each arm and the second ring.

39. A chandelier frame as set forth in claim 38 wherein the joints between the arms and the first ring are offset from radial alignment with respect to the joints between the arms and the second ring to the same degree.

40. A chandelier frame as set forth in claim 38 wherein the first ring, second ring and arms are cut as an integral piece from a single flat sheet of material, the workpiece being free of breaks.

41. A chandelier frame as set forth in claim 38 wherein the arms are curved.

42. A chandelier frame as set forth in claim 38 wherein the joints are constructed and arranged so as to permit plastic and asymmetric deformation of the joints to displace the rings axially with respect to one another.

43. A chandelier frame as set forth in claim 38 wherein the joints define a narrow region relative to the arms and the rings.

44. A chandelier frame as set forth in claim 38 wherein the joints between the arms and the first ring form an acute angle on one side and an obtuse angle on an opposite side.

45. A workpiece for a chandelier frame comprising:

a first ring;

a second ring concentric and lying within the first ring, the first ring and the second ring being substantially flat and coplanar; and a plurality of arms connecting the first ring and the second ring at joints, the joints being constructed and arranged to permit plastic and asymmetric deformation of the joints without substantial deformation of the first ring, the second ring and the arms.

46. A chandelier frame as set forth in claim 45 wherein the joints are narrowed with respect to the arms and first ring and second ring.

47. A chandelier frame as set forth in claim 45 wherein each of the arms carries a locking structure.

48. A chandelier frame as set forth in claim 47 wherein the locking structure comprises a deformable tab.

49. A chandelier frame as set forth in claim 45 wherein the arms are curved.

50. A chandelier frame as set forth in claim 45 wherein the arms include a plurality of legs.

51. A chandelier frame as set forth in claim 50 wherein the arms each comprise a loop.

52. A chandelier frame as set forth in claim 45 wherein each joint comprises a narrow runner constructed and arranged to permit a twist to be formed thereover.

53. A workpiece for a chandelier frame comprising:

a plurality of frame loops interconnected to form a ring; and a plurality of arms, each arm being within one of the frame loops and interconnecting opposite ends of its respective frame loop.

54. A chandelier frame as set forth in claim 53 wherein the arms are loops.

55. A chandelier frame as set forth in claim 54 wherein the arms carry a locking structure.

56. A chandelier frame as set forth in claim 55 wherein the locking structure comprises a deformable tab.

57. A chandelier frame as set forth in claim 52 wherein the arms are connected to the frame loops at joints, the joints constructed and arranged to permit the arms to be twisted into a plane substantially transverse to a plane defined by the frame loops.

58. A chandelier frame as set forth in claim 57 wherein the joints are narrowed with respect to the arms and frame loops.

59. A method for constructing a chandelier frame comprising:

providing a first frame member lying substantially in a plane;

providing a second frame member lying substantially in the plane;

providing a plurality of arms connecting the first frame member and the second frame member, wherein the first frame member is connected to each arm at each of a plurality of first joints and the second frame member is connected to each arm at each of a plurality of second joints, the arms lying substantially in the plane; and plastically and asymmetrically deforming each of the first and each of the second joints so that the first frame member and the second frame member are located in each of a plurality of axially remote planes.

60. A method as set forth in claim 59 wherein the step of plastically and asymmetrically deforming includes applying a separation force, to separate the first frame member and the second frame member, in a direction substantially perpendicular to the plane, and causing a rotation between the first frame member and the second frame member.

61. A method as set forth in claim 59 wherein the step of plastically and asymmetrically deforming includes twisting the arms to rotate the arms.

62. A method as set forth in claim 61 further comprising attaching a third frame member to each of the rotated arms to provide additional stiffness to the arms.

63. A method for constructing a chandelier frame comprising:

providing a first frame member lying substantially in a plane;

providing a second frame member lying substantially in the plane, the second frame member being remote from the first frame member;

providing a plurality of arms, the arms interconnecting the first frame member and the second frame member; and applying a force to separate the first frame member and the second frame member in a direction substantially perpendicular to the plane and to cause a rotation between the first frame member and the second frame member, thereby locating the first frame member and the second frame member in planes that are axially remote from each other.

64. A method of constructing a chandelier frame comprising:

providing a frame member lying substantially in a plane in an unstressed state;

applying stress at three or more points concentric to the perimeter of the frame member, the stress causing elastic deformation in the frame member to from a predetermined bowl-shape; and securing the frame member in an elastically stressed state to maintain the predetermined bowl-shape.

65. A method as set forth in claim 64 wherein the frame member comprises a pair of rings connected by integrally attached arms, the frame member being free of breaks.

66. A method as set forth in claim 64 wherein the step of applying stress comprises plastically deforming predetermined sections of the frame member so that portions interconnected therewith are oriented transversely to the plane; and wherein the step of securing comprises attaching a locking structure to the portions to maintain the frame member in the predetermined bowl-shape.

67. A method for constructing a chandelier frame comprising:

providing a first frame member having a first pair of locking structures that are spaced at predetermined spacing when the frame member lies in a plane in an unstressed state;

providing a second frame member having a second pair of locking structures that interengage the first pair of locking structures, the second pair of locking structures having a second predetermined spacing that is different than the first predetermined spacing; and elastically deforming the first frame member and attaching the first pair of locking structures to the second pair of locking structures to maintain the first frame member in an elastically deformed state.

68. A method as set forth in claim 67 wherein the first frame member has a first width and the second frame member has a second width, the first and second widths defining planes that are transverse to one another.

69. A method as set forth in claim 67 wherein the first frame member is elastically deformed into a bowl-shape.

70. A method for constructing a chandelier frame comprising:

providing a first frame member having a first locking structure;

providing a second frame member having a second locking structure;

providing a third frame member having a third locking structure and a fourth locking structure constructed and arranged to interengage with the first locking structure and the second locking structure, respectively; and attaching the first locking structure to the third locking structure and the second locking structure to the fourth locking structure, the step of attaching including elastically deforming the first frame member so that the second locking structure is aligned with the fourth locking structure, whereby the first frame member retains an elastically deformed state when the first locking structure is engaged with the third locking structure and the second locking structure is engaged with the fourth locking structure.

71. A method as set forth in claim 70 wherein the step of providing the first frame member includes providing a first ring having a plurality of first locking structures thereon.

72. A method as set forth in claim 71 wherein the step of providing the second frame member includes providing a second ring having a plurality of second locking structures thereon.

73. A method as set forth in claim 72 wherein the step of providing the third frame member includes providing an arm and wherein the step of attaching includes interconnecting the arm to each of the first ring and the second ring to space each of the first ring and the second ring at each of axially remote points.

74. A chandelier frame comprising:

a first ring;

a second ring interconnected at predetermined first points to the first ring;

a plurality of arms interconnecting the first ring and the second ring at predetermined second joints, the joints being plastically deformed and each defining a twisted shape thereover, wherein the arms including locking structures that are positioned remote from the first ring; and a locking frame member, interengaging each of the locking structures, the locking frame member being constructed and arranged so that when the locking frame member is interengaged with the locking structures, the first ring and the second ring are in a stressed, elastically deformed state defining a bowl-shape.

75. A chandelier frame as set forth in claim 74 wherein the first ring defines an undulating outline about an outer perimeter thereof.

76. A chandelier frame as set forth in claim 74 wherein at least one of the first ring and the second ring includes a plurality of arm support structures, the arm support structures receiving chandelier arms for support of the first ring and the second ring relative to the chandelier arms.

77. A method for forming a two-tier chandelier frame comprising:

providing a substantially flat frame member having a base, a first arm extending from the base, a first support structure extending from the first arm and a second support structure interconnected by a runner to the arm, the second support structure including a second arm extending therefrom, the second arm having a free end;

plastically and asymmetrically deforming the runner so that the second support structure is aligned in a plane axially remote from a plane defined by the first support structure;

plastically deforming the second arm so that the free end is located adjacent the base; and attaching the second arm to the base.

78. A method as set forth in claim 77 wherein the second arm has a width that is greater than a thickness and the step of plastically deforming the second arm includes aligning the second arm so that the width is aligned in a plane substantially perpendicular to the plane defined by the first support structure.

79. A method as set forth in claim 78 wherein the step of attaching includes interengaging a tab on the second arm with a slot on the base.

* * * * *